US008568029B2

(12) United States Patent
Kannankeril et al.

(10) Patent No.: US 8,568,029 B2
(45) Date of Patent: Oct. 29, 2013

(54) INFLATABLE MAILER, APPARATUS, AND METHOD FOR MAKING THE SAME

(75) Inventors: Charles Kannankeril, North Caldwell, NJ (US); Ian Donegan, Morristown, NJ (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 413 days.

(21) Appl. No.: 12/387,577

(22) Filed: May 5, 2009

(65) Prior Publication Data

US 2010/0282824 A1 Nov. 11, 2010

(51) Int. Cl.
*B65D 30/00* (2006.01)
*B65D 33/24* (2006.01)
*B65D 81/02* (2006.01)

(52) U.S. Cl.
USPC ..... 383/3; 383/84; 206/522

(58) Field of Classification Search
USPC ..... 383/3, 84; 206/522
See application file for complete search history.

(56) References Cited

U.S. PATENT DOCUMENTS 3,382,642 A 5/1968 Shaw
3,742,994 A 7/1973 Pensak
3,745,024 A 7/1973 Ford et at
4,360,996 A 11/1982 Rutter
4,465,188 A 8/1984 Soroka et al.
4,489,833 A * 12/1984 Bauer ..... 206/522
4,534,154 A 8/1985 Gaubert
4,551,379 A 11/1985 Kerr
4,569,082 A * 2/1986 Ainsworth et al. ..... 383/3
4,597,244 A 7/1986 Pharo
4,770,337 A 9/1988 Leibe
4,872,558 A 10/1989 Pharo
4,896,479 A 1/1990 Gannon
5,009,318 A * 4/1991 Lepinoy ..... 206/524.8
5,046,621 A 9/1991 Bell
5,070,675 A 12/1991 Chuan-Shiang
5,263,587 A * 11/1993 Elkin et al. ..... 206/522
5,269,122 A 12/1993 Reichental et al.
5,273,361 A 12/1993 Jillson
5,454,642 A 10/1995 De Luca
5,487,470 A * 1/1996 Pharo ..... 206/522
5,727,270 A 3/1998 Cope et al.
5,791,476 A 8/1998 Stekloff
5,826,723 A * 10/1998 Jaszai ..... 206/522
5,845,806 A 12/1998 Parchman
5,862,914 A 1/1999 Farison et al.
6,109,440 A 8/2000 Cliff
6,139,188 A 10/2000 Marzano
6,183,838 B1 2/2001 Kannankeril
6,209,724 B1 4/2001 Miller
6,253,806 B1 7/2001 Sperry et al.
6,276,532 B1 8/2001 Sperry et al.
6,283,296 B1 * 9/2001 Newman ..... 206/522

(Continued)

FOREIGN PATENT DOCUMENTS

DE 42 19 258 A1 6/1992
DE 296 00 373 U1 1/1996

(Continued)

*Primary Examiner* — Jes F Pascua
(74) *Attorney, Agent, or Firm* — Ashley D. Wilson

(57) ABSTRACT

The presently disclosed subject matter relates generally to mailers for shipping objects, and more particularly to mailers comprising an outer pouch and an inner inflatable liner and an inflation pathway through which a portion of gas can be introduced into said inflatable liner.

20 Claims, 37 Drawing Sheets

(56) References Cited

U.S. PATENT DOCUMENTS

| | | | | |
|---|---|---|---|---|
| 6,410,119 | B1 | 6/2002 | De Luca et al. | |
| 6,423,166 | B1 | 7/2002 | Simhaee | |
| 6,565,946 | B2 | 5/2003 | Perkins et al. | |
| 6,569,283 | B1 | 5/2003 | Sperry et al. | |
| 6,761,960 | B2 | 7/2004 | De Luca et al. | |
| 6,800,162 | B2 | 10/2004 | Kannankeril et al. | |
| 6,913,389 | B2 | 7/2005 | Kannankeril et al. | |
| 6,913,803 | B2 * | 7/2005 | Peper | 428/35.2 |
| 6,978,893 | B2 * | 12/2005 | Peper | 206/522 |
| 6,982,113 | B2 | 1/2006 | Kannankeril et al. | |
| 7,018,495 | B2 | 3/2006 | Kannankeril et al. | |
| 7,041,361 | B2 | 5/2006 | Thomsen et al. | |
| 7,066,331 | B2 * | 6/2006 | Koyanagi et al. | 206/522 |
| 7,106,202 | B2 * | 9/2006 | Dickinson | 340/572.8 |
| 7,108,650 | B2 | 9/2006 | Marzano | |
| 7,168,566 | B2 * | 1/2007 | Anderson et al. | 206/522 |
| 7,168,567 | B2 * | 1/2007 | Peper et al. | 206/522 |
| 7,223,461 | B2 | 5/2007 | Kannankeril et al. | |
| 7,297,387 | B2 * | 11/2007 | Koyanagi | 428/166 |
| D603,705 | S | 11/2009 | Wehrmann | |
| 7,681,734 | B2 * | 3/2010 | Liao et al. | 206/522 |
| 2002/0166788 | A1 | 11/2002 | Sperry et al. | |
| 2003/0037858 | A1 | 2/2003 | Kannankeril et al. | |
| 2003/0109369 | A1 | 6/2003 | Lerner et al. | |
| 2003/0161999 | A1 | 8/2003 | Kannankeril et al. | |
| 2003/0163976 | A1 | 9/2003 | Perkins et al. | |
| 2004/0000581 | A1 | 1/2004 | Brandolini et al. | |
| 2004/0101658 | A1 | 5/2004 | Kannankeril et al. | |
| 2004/0101659 | A1 | 5/2004 | Kannankeril et al. | |
| 2004/0171469 | A1 | 9/2004 | Brandolini et al. | |
| 2004/0206050 | A1 | 10/2004 | Fuss et al. | |
| 2004/0265521 | A1 | 12/2004 | Marzano | |
| 2005/0126941 | A1 * | 6/2005 | Ferri et al. | 206/323 |
| 2005/0247592 | A1 * | 11/2005 | Peper et al. | 206/522 |
| 2006/0108052 | A1 | 5/2006 | Kannankeril et al. | |
| 2006/0169753 | A1 | 8/2006 | Piucci et al. | |
| 2006/0210773 | A1 | 9/2006 | Kannankeril | |
| 2007/0068118 | A1 | 3/2007 | Forss | |
| 2008/0066852 | A1 | 3/2008 | Wetsch et al. | |
| 2008/0093426 | A1 | 4/2008 | Kircher, Jr. | |
| 2008/0209854 | A1 | 9/2008 | Gustafsson | |
| 2010/0043353 | A1 | 2/2010 | Piucci et al. | |
| 2010/0096290 | A1 * | 4/2010 | Frayne et al. | 206/522 |
| 2010/0101970 | A1 * | 4/2010 | Frayne et al. | 206/522 |
| 2011/0120899 | A1 * | 5/2011 | Sorensen | 206/522 |

FOREIGN PATENT DOCUMENTS

| | | | |
|---|---|---|---|
| EP | 1688245 | A1 | 8/2006 |
| WO | WO 00/71423 | A1 | 11/2000 |
| WO | 03/104089 | A2 | 12/2003 |
| WO | 2008/126677 | A1 | 10/2008 |

* cited by examiner

INFLATABLE MAILER, APPARATUS, AND METHOD FOR MAKING THE SAME

BACKGROUND

The presently disclosed subject matter relates generally to mailers for shipping objects, and more particularly to mailers comprising an outer pouch and an inner inflatable liner and an inflation pathway through which a portion of gas can be introduced into said inflatable liner.

Consumers frequently purchase goods from mail order or internet retailers. According to the Census Bureau of the U.S. Department of Commerce, retail e-commerce sales for 2006 reached 107 billion dollars in the U.S. alone, the highest total ever. As a result, millions of packages are being shipped each day. Many of these packages include small items such as pharmaceuticals, books, medical supplies, electronic parts, and the like. These items are normally packaged in small containers, such as boxes or envelopes. To protect the items during shipment, they are typically packaged with some form of protective dunnage that can be wrapped around the item or stuffed into the container to prevent movement of the item and to protect against shock.

One common packaging method uses corrugated boxes to hold and ship items. The spaces between the items and the inside walls of the box are filled with void-filling dunnage, such as foam peanuts, air cellular cushioning materials, crumpled or shredded paper, and/or other air-filled packaging materials. Typically, the corrugated boxes are supplied to the shipper in a collapsed condition to occupy less space. Each box must then be assembled and taped before use by the shipper, resulting in additional labor costs.

The void-filling dunnage must also be delivered to the shipper. The shipper normally warehouses a supply of dunnage for future use. Conventional dunnage materials, such as air cellular material or foam peanuts, are composed primarily of air. Shipping costs associated with these packaging materials are generally based on volume rather than weight, resulting in increased transportation costs. Paper dunnage is more economical to ship, but requires additional labor to convert to usable dunnage. Thus, void-filling materials can increase the costs associated with shipping items.

Another type of common shipping method includes the use of a padded mailer. Padded mailers are generally shipping envelopes that have padded walls to protect the contents of the mailer. Some padded mailers are constructed from a double wall paper envelope with paper dunnage between the walls. Another type of mailer contains air cellular material lining the inside surfaces of the envelope. These envelopes can be made of paper or plastic such as Tyvek® (available from E.I. DuPont de Nemours and Company, Wilmington, Del., United States of America). Similar to foam peanuts and air cellular materials, these padded mailers are typically comprised mostly of air. They are normally expensive to deliver to the shipper, and require a large storage space. The padded mailers are typically limited to relatively thin padding so that their size is both practical and economic. As a result, the protective capabilities of these padded envelopes can be limited.

In addition, a further type of common shipping method includes the use of an Xpander Pak®. The Xpander Pak® shipper contains thick foam walls that are compressed and vacuum sealed on each side. The foam walls are positioned inside of a durable film pouch such that the foam surrounds the product to be packaged. After the package is sealed, each side of the pouch is punctured to release the vacuum and allow the foam walls to expand around the packaged product. However, the Xpander Pak® is costly to manufacture compared to other shipping methods commonly used in the art.

Additional methods of providing protective dunnage include the use of polyurethane foam cushions and air cushions that are prepared on-site. These methods typically require the use of more expensive equipment and additional space to position the equipment near the point of packaging.

Thus, there exists a need for providing a mailer for the shipment of items that requires less storage space and more economical than those mailers currently used in the art. In addition, there exists a need for a system that enables a shorter cycle time between inflation and sealing compared to other mailer systems currently used in the art. Further, there exists a need in the art for simpler and lower cost equipment for producing a mailer as compared to equipment currently used. There also exists a need for a mailer that does not require pre-filling, which can be cumbersome and time-consuming.

SUMMARY

In some embodiments, the presently disclosed subject matter is directed to an inflatable mailer, wherein the inflatable mailer comprises front and rear sheets that are oriented in face-to-face relation. In some embodiments, each sheet comprises a top edge, a bottom edge, and two opposite side edges, wherein the sheets are connected along the bottom edge and along opposite side edges to define an interior space. In some embodiments, the top edges of the sheets are unconnected to form an opening into the interior space. In some embodiments, each sheet comprises at least one pouch inflation port positioned at the top or bottom edge of at least one sheet. In some embodiments, the inflatable mailer comprises an inflatable liner disposed in the interior space, wherein the inflatable liner comprises front and rear webs oriented in face-to-face relation. In some embodiments, each web comprises a top edge, a bottom edge, and opposite side edges, wherein the side edges of the front and rear webs are interconnected and at least one of the top or bottom edges are at least partially connected. In some embodiments, each web comprises two sheets having inner surfaces sealed to each other in a pattern defining a series of inflatable chambers and at least one common channel in fluid communication with the series of inflatable chambers. In some embodiments, each web comprises a liner inflation port disposed in at least one of the two sheets in at least one of the two webs, wherein the liner inflation ports are aligned with the pouch inflation ports, and whereby an inflation pathway is created through which a portion of gas can be introduced into the liner.

In some embodiments, the presently disclosed subject matter is directed to a method of forming an inflatable mailer, said method comprising providing two sheets, wherein each sheet comprises a top edge, a bottom edge, and two opposite side edges. In some embodiments, the sheets are oriented in a face-to-face relation. In some embodiments, the sheets are connected along the bottom edges and along the opposite side edges to define an interior space. In some embodiments, at least one pouch inflation port is formed at the top or bottom edge of at least one sheet. In some embodiments, an inflatable liner comprising front and rear webs oriented in face-to-face relation is provided. In some embodiments, each web comprises a top edge, a bottom edge, and opposite side edges, wherein the side edges of the front and rear webs are interconnected and at least one of the top or bottom edges are at least partially connected. In some embodiments, each web comprises two sheets having inner surfaces sealed to each other in a pattern defining a series of inflatable chambers and at least one common channel in fluid communication with the series of inflatable chambers. In some embodiments, each web comprises a liner inflation port disposed in at least one of the two sheets in at least one of the two webs. In some embodiments, the inflatable liner is disposed into the interior space, wherein the liner inflation ports are aligned with the pouch inflation ports.

In some embodiments, the presently disclosed subject matter is directed to a method of protecting an article during shipment, said method comprising providing two sheets, wherein each sheet comprises a top edge, a bottom edge, and two opposite side edges. In some embodiments, the sheets are oriented in a face-to-face relation. In some embodiments, the sheets are connected along the bottom edges and along the opposite side edges to define an interior space, wherein the top edges of the sheets are unconnected to form an opening into the interior space. In some embodiments, at least one pouch inflation port is formed at the top or bottom edge of at least one sheet. In some embodiments, an inflatable liner comprising front and rear webs oriented in face-to-face relation is provided. In some embodiments, each web comprises a top edge, a bottom edge, and opposite side edges, wherein the side edges of the front and rear webs are interconnected and at least one of the top or bottom edges are at least partially connected. In some embodiments, each web comprises two sheets having inner surfaces sealed to each other in a pattern defining a series of inflatable chambers and at least one common channel in fluid communication with the series of inflatable chambers. In some embodiments, each web comprises a liner inflation port disposed in at least one of the two sheets in at least one of the two webs. In some embodiments, the inflatable liner is disposed into the interior space, wherein the liner inflation ports are aligned with the pouch inflation ports. In some embodiments, the article is inserted between the two webs, the opening is closed, and the inflatable liner is inflated. In some embodiments, the front and rear webs are then sealed together to close off the inflation ports from the inflatable channels to thereby produce an inflated mailer. In some embodiments, the article is then shipped.

In some embodiments, the presently disclosed subject matter is directed to a method of protecting an article during shipment. In some embodiments, the method comprises providing two sheets, wherein each sheet comprises a top edge, a bottom edge, and two opposite side edges. In some embodiments, the method comprises orienting the sheets in a face-to-face relation and connecting the sheets along the bottom edges and along the opposite side edges to define an interior space, wherein the top edges of the sheets are unconnected to form an opening into the interior space. In some embodiments, the method comprises forming at least one pouch inflation port at the top or bottom edge of at least one sheet. In some embodiments, the method then comprises providing an inflatable liner comprising front and rear webs oriented in face-to-face relation, wherein each web comprises a top edge, a bottom edge, and opposite side edges, wherein the side edges of the front and rear webs are interconnected and at least one of the top or bottom edges are at least partially connected. In some embodiments, each web comprises two sheets having inner surfaces sealed to each other in a pattern defining a series of inflatable chambers and at least one common channel in fluid communication with the series of inflatable chambers. In some embodiments, each web comprises a liner inflation port disposed in at least one of the two sheets in at least one of the two webs. In some embodiments, the method comprises disposing the inflatable liner into the interior space, wherein the liner inflation ports are aligned with the pouch inflation ports. In some embodiments, the method comprises inflating the inflatable liner, sealing the front and rear webs together to close off the inflation ports from the inflatable channels to thereby produce an inflated mailer, and inserting the article between the two webs. In some embodiments, the opening is then closed and the article is shipped.

DETAILED DESCRIPTION

I. General Considerations

The presently disclosed subject matter now will be described more fully hereinafter with reference to the accompanying drawings in which some (but not all) embodiments are shown. Indeed, the presently disclosed subject matter can be embodied in many different forms and should not be construed as limited to the embodiments set forth herein. Rather, the disclosed embodiments are provided so that the disclosure will satisfy applicable legal requirements. Like numbers refer to like elements throughout.

Figure 1A:
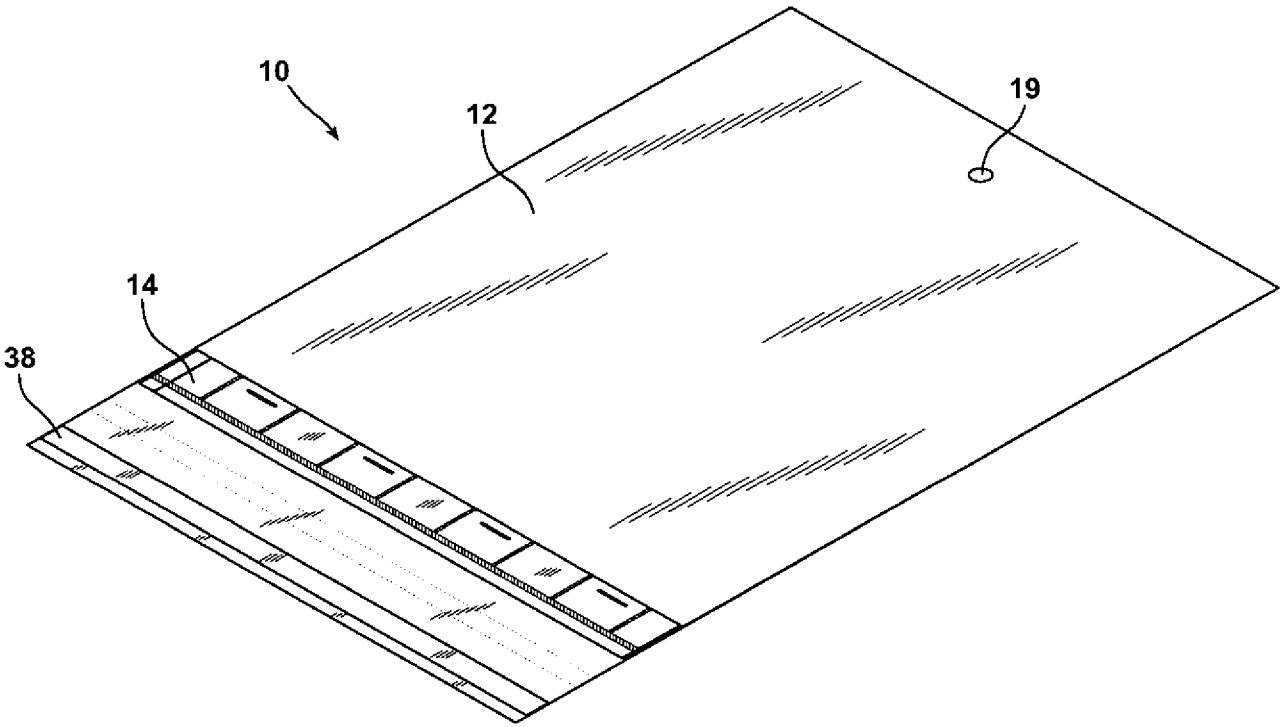
FIG. 1*a* is a perspective view of one embodiment of the disclosed inflatable mailer in an uninflated state.
Figure 1B:
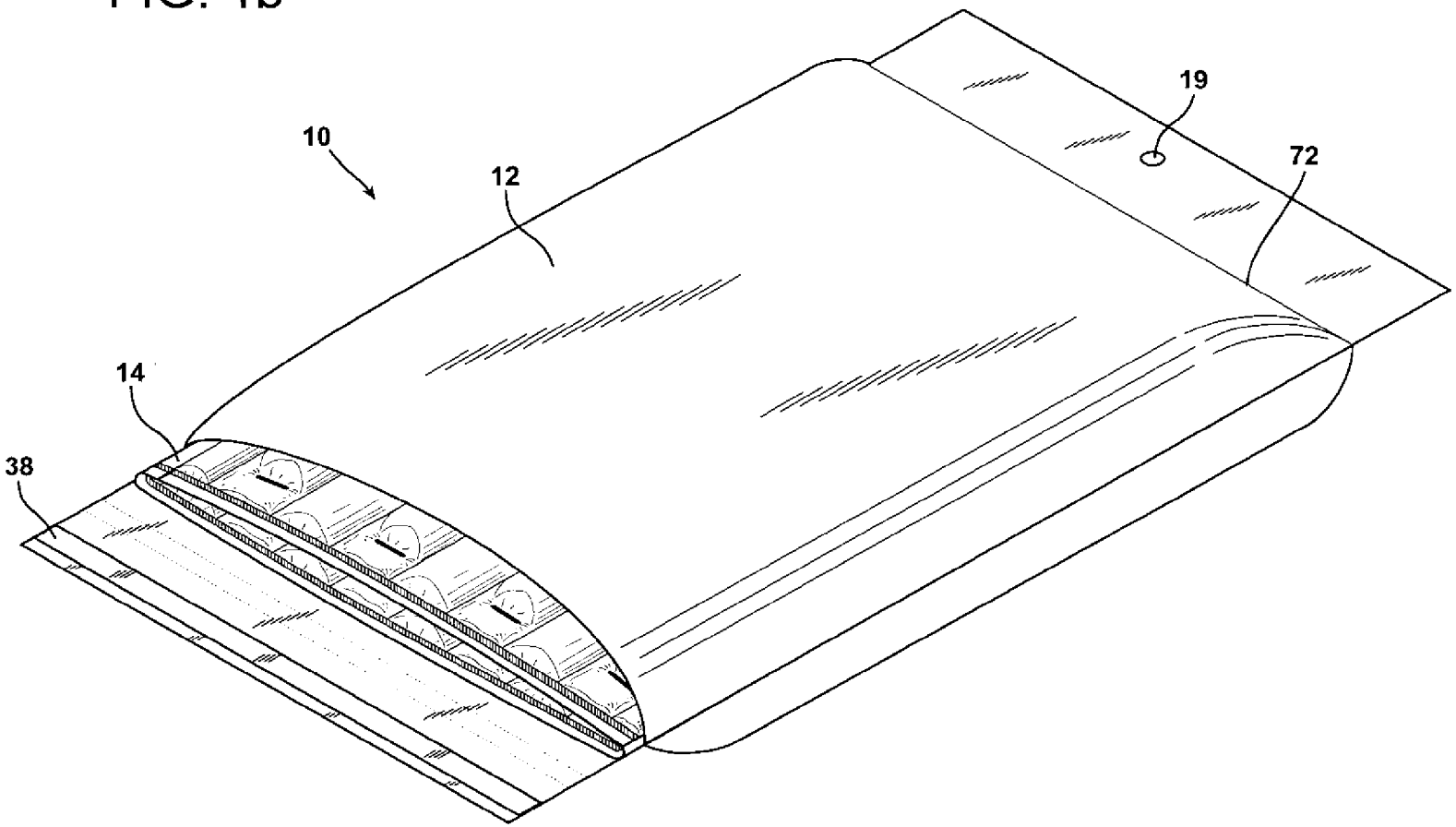
FIG. 1*b* is a perspective view of the inflatable mailer of FIG. 1*a* after it has been inflated.

With reference to FIGS. 1*a* and 1*b*, an inflatable mailer in accordance with the presently disclosed subject matter is illustrated and broadly designated as reference number 10. As shown in FIG. 1*a*, inflatable mailer 10 comprises pouch 12 with inflatable liner 14 disposed within the interior of the pouch. Inflatable liner 14 typically comprises a web of air cellular cushioning material that can be inflated at a desired time. As shown in FIG. 1*a*, inflatable liner 14 can be manufactured and transported in a relatively compact and uninflated state. As a result, the volume occupied by inflatable mailer 10 can be substantially less than the volume occupied by a corresponding inflated mailer (see FIG. 1*b*).

Inflatable liner 14 can be inflated at the point of packaging or at some other suitable location using the inflation/sealing assembly disclosed herein below. In this regard, FIG. 1*b* illustrates mailer 10 after inflation of liner 14. As shown in FIG. 1*b*, the volume of space occupied by the inflated liner is substantially increased. As discussed in more detail herein below, mailer 10 also comprises at least one pouch inflation port and at least one liner inflation port. For example, FIGS. 1*a* and 1*b* illustrate upper and lower pouch inflation ports 19, 21 and upper and lower liner inflation ports 17, 23 (not shown) for inflating the mailer.

II. Definitions

While the following terms are believed to be understood by one of ordinary skill in the art, the following definitions are set forth to facilitate explanation of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a mailer" can include a plurality of such mailers, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments ±20%, in some embodiments ±10%, in some embodiments ±5%, in some embodiments ±1%, in some embodiments ±0.5%, and in some embodiments to ±0.1%, from the specified amount, as such variations are appropriate in the disclosed packages and methods.

"Air cellular material" herein refers to cushioning material, such as BUBBLE WRAP™ air cushioning material sold by Sealed Air Corporation, where one film or laminate is thermoformed, embossed, calendared, or otherwise processed to define a plurality of cavities, and another film is adhered to the "open" side of the thermoformed or otherwise processed film or laminate in order to close the cavities. Air cellular material typically utilizes two films that are laminated together. Usually, only one of the films is embossed, i.e., thermoformed in a manner to provide a plurality of protrusions when viewed from one side of the film, the protrusions being cavities when viewed from the other side of the film. Generally, the protrusions can be regularly spaced and have a cylindrical shape, with a round base and a domed top. The formed film is generally laminated to a flat film in order to form the air cellular product. In some embodiments, two formed films are laminated to one another to form the cellular product. Conventional methods of making such material involve the use of a vacuum source to deform polymer film to form bubbles or pockets that can be filled with air (or other gases) to form bubbles. Such materials can be made using a heated drum having recesses that are connected to a vacuum source. When vacuum is applied, each of various regions of the heated film in contact with the drum is drawn into respective recesses on the drum. The heated film is deformed and thinned in the regions drawn into the recess by the vacuum process. One portion of the resulting film remains "flat", while another portion is not flat, but rather is "thermoformed". A second film, which preferably is a flat film, i.e., not thermoformed, is fused to the flat portion of the formed film, resulting in a plurality of sealed, air-filled "bubbles." Alternatives such as laminating two films together, and then inflating the interior of the two sheets to form a plurality of inflated cells, is also within the scope of "air cellular material" as used herein. Other alternatives within this definition are shown in U.S. Pat. No. 3,660,189 (Troy), U.S. Pat. Nos. 4,576,669 and 4,579,516 (Caputo), U.S. Pat. No. 4,415,398 (Ottaviano), U.S. Pat. Nos. 3,142,599, 3,508,992, 3,208,898, 3,285,793, and 3,616,155 (Chavannes), U.S. Pat. No. 3,586,565 (Fielding), U.S. Pat. No. 4,181,548 (Weingarten), and U.S. Pat. No. 4,184,904 (Gaffney), all of which are incorporated herein by reference in their entireties. It is known to prepare laminated inflatable articles which can be shipped to a converter uninflated, and inflated immediately before use. Such inflatable articles are typically made from two heat sealable films which are fused together in discrete areas to form one or more inflatable channels. Alternatively, conventional air cellular material fabricating processes can include a first stage film fabrication step and a separate second stage fusing step. In the first stage, polymer films are fabricated by conventional techniques known to those in the art of polymer film fabrication. In the second stage, the polymer films are combined according to any of a wide variety of methods that are known to those in the art of polymer film sealing techniques, including (but not limited to) heat sealing and/or adhesives. In yet another alternative, plastic webs constitute a plurality of transparent thermoplastic laminae joined face to face and formed so that the laminae mutually define a multiplicity of pockets which are filled with gas. "Air cellular material" herein specifically excludes foamed materials.

The term "bottom" as used herein refers to the side of a pouch, liner, or mailer that is opposite the top.

As used herein, the term "connected" or "connecting" when referring to materials of the disclosed mailer can include a fold in the material or to adhesion of the material using heat seal and/or an adhesive. Thus, for example, if a pouch comprises two sheets that are connected on all edges, the pouch can comprise two separate sheets that are sealed on all edges using adhesive and/or heat seal. Alternatively, the pouch can comprise one sheet of material that has been folded to create one folded edge and 3 other edges sealed via heat seal and/or adhesive. Accordingly, the term "unconnected" when referring to the materials of the disclosed mailer can refer to the absence of a fold, heat seal, and/or adhesive in the material.

As used herein, the term "film" is used in a generic sense to include plastic web, regardless of whether it is film or sheet. Preferably, films of and used in the presently disclosed subject matter have a thickness of 0.5 to 10 mils.

Figure 8A:
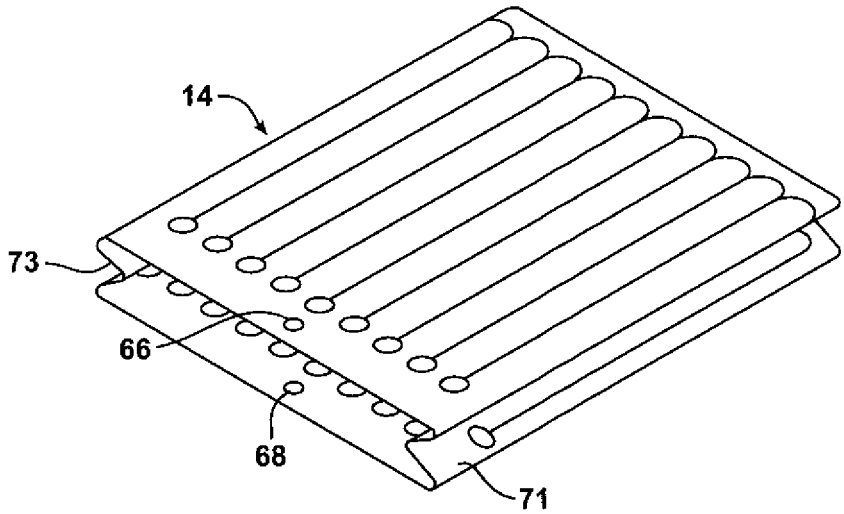
FIG. 8*a* is a perspective view of one embodiment of a gusseted liner.

As used herein, the term "gusset" or "gusseted" refers to a formation in a pouch or liner that is caused by creasing an area to form an inwardly directed folded in-and-out portion of material, as shown in FIG. 8*a* herein. The term "non-gusseted" refers to the absence of gussets in a pouch or mailer.

The term "inflatable" as used herein refers to an element than can be filled with air and/or gas.

The term "inflation means" refers to any of a wide variety of apertures that serve as a means by which a gas can be transported into the liner of the presently disclosed subject matter. In some embodiments, the inflation means can comprise an inflation port, a valve, and/or combinations thereof. Such inflation means are well known to those of ordinary skill in the art.

The term "inflation port" refers to any aperture that serves as a means by which a gas can be transported into the liner of the presently disclosed mailer. In some embodiments, the inflation port can comprise a hole and/or a slit.

The term "liner" as used herein refers to a reservoir or other structure that is capable of holding or housing an amount of air or gas.

As used herein, the term "mailer" refers any configuration or type of container capable of holding or carrying one or more objects that is transmittable via mail or other delivery from a sender to a recipient. For example, mailers can include (but are not limited to) traditional letter envelopes, pouches, foldable mailers, carriers, packages, self-mailers, welded seam envelopes, open side envelopes, open end envelopes, delivery or carrier envelopes of any size, such as DVD mail pieces and overnight carrier mail pieces (FEDEX, US Postal Service, etc.).

As used herein, the term "opening" refers to a portion of the top surface that allows a user to access an article housed within the interior volume of the disclosed mailer.

The term "pouch" herein includes a pouch, a bag, or like containers, either pre-made or made at the point of packaging.

As used herein, the term "seal" refers to any seal of a first region of a film surface to a second region of a film or substrate surface. In some embodiments, the seal can be formed by heating the regions to at least their respective seal initiation temperatures using a heated bar, hot air, infrared radiation, ultrasonic sealing, and the like. In some embodiments, the seal can be formed by an adhesive.

The term "top" as used herein refers to the side of a pouch, liner, or mailer that includes the opening of the mailer when assembled. As used herein, terminology such as "vertical", "horizontal", "top", "bottom", "front", "rear", "end" and "side" are referenced according to the views presented. It should be understood, however, that the terms are used only for purposes of description and are not intended to be used as limitations.

The term "web" as used herein refers to sheets of thermoplastic material that can be used during the manufacture of pouches or bags. In some embodiments, the term "web" can refer to a set of two films that are pattern sealed together.

All compositional percentages used herein are presented on a "by weight" basis, unless designated otherwise.

III. Inflatable Mailer 10

III.A. Pouch 12

Figure 2B:
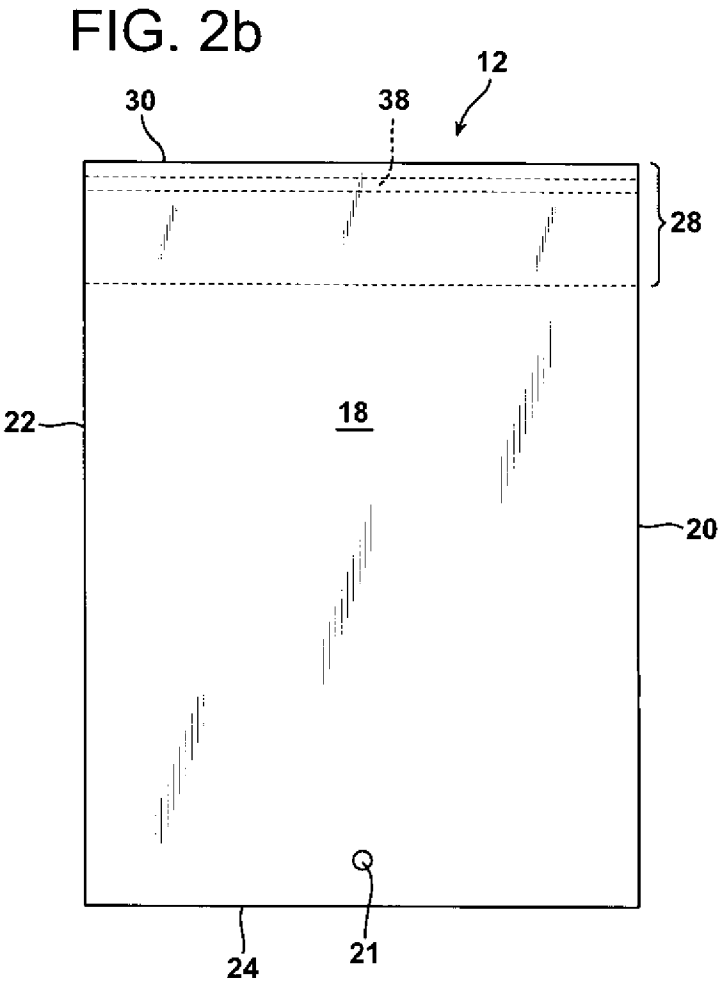
FIG. 2*b* is a bottom plan view of the pouch of FIG. 2*a*.
Figure 2A:
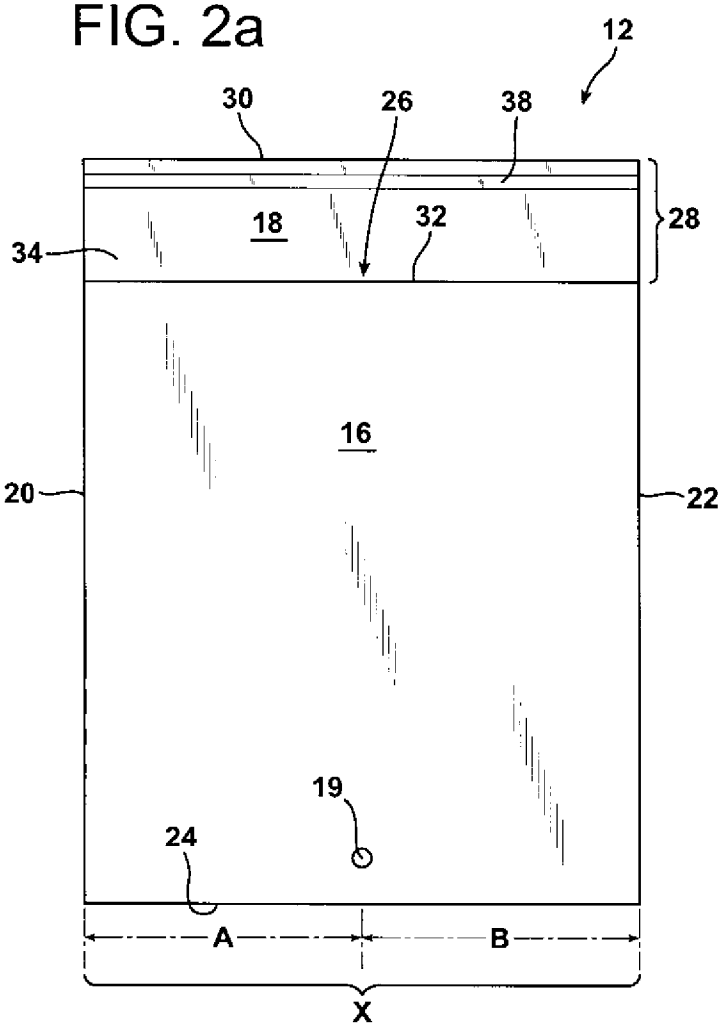
FIG. 2*a* is a top plan view of one embodiment of the outer pouch of the inflatable mailer.

Inflatable mailer 10 comprises pouch 12 with inflatable liner 14 disposed within the interior of the pouch. FIGS. 2*a* and 2*b* illustrate top and bottom views, respectively, of pouch 12. Particularly, pouch 12 comprises front sheet 16 and rear sheet 18, wherein each sheet comprises a top edge, a bottom edge, and two opposite side edges. Front and rear sheets 16, 18 are oriented in a face-to-face relation and are connected to each other at side edges 20, 22 and bottom edge 24. Thus, front and rear sheets 16, 18 are connected along the bottom edge and along the opposite side edges to form an interior space and the top edges are unconnected to form an opening into the interior space. In some embodiments, the side and bottom edges of pouch 12 are permanently sealed using methods well known in the art. Particularly, edges 20, 22, 24 can be attached to each other using a variety of bonding techniques including, for example, heat seal and/or adhesive. Heat seals are preferred and, for brevity, the term "heat seal" is generally used hereinafter. This term should be understood to include the formation of seals by adhesion of edges 20, 22, 24 of the front and rear sheets to each other with an adhesive, thermal, ultrasonic fusion, radio frequency, and/or other suitable sealing methods.

Front and rear sheets 16, 18 can comprise two separate sheets, or alternatively, a single sheet that has been folded at bottom edge 24. In embodiments wherein a single sheet is folded to create pouch 12, pouch bottom edge 24, instead of being formed via heat seal or other suitable means, is simply the fold in the original sheet. Together sheets 16, 18 define pouch 12 having an interior space for receiving an article. The unconnected top edges of sheets 16, 18 define pouch opening 26 through which the article can be placed into the interior of the pouch.

Pouch 12 comprises at least one pouch inflation port positioned at the top or bottom edge of at least one sheet to allow direct communication with an inflation means. For example, in some embodiments, pouch 12 can comprise upper and lower pouch inflation ports 19, 21, respectively, that span front and rear sheets 16, 18. In some embodiments, the pouch inflation ports are aligned to allow direct communication with an inflation means. Pouch inflation ports 19, 21 can be formed using any of a wide variety of methods known in the art, including (but not limited to) the use of an air-activated hole punch cylinder, rotary cutter, press cutter, punch and rotary anvil combination, and/or knife (including a star knife to form a multi-cross hatched slit). Such methods are well known to those of ordinary skill in the art.

In some embodiments, the pouch inflation port(s) can be positioned in close proximity to pouch bottom edge 24 and approximately equidistant from pouch side edges 20, 22. For example, as depicted in FIG. 2*a*, "X" represents the total distance between pouch side edges 20, 22. "A" represents the horizontal distance between pouch inflation ports 19, 21 and pouch side edge 20, and "B" represents the horizontal distance between pouch inflation ports 19, 21 and pouch side edge 22. In some embodiments, pouch inflation ports 19, 21 can be positioned such that the difference in distance between A and B is 40% or less of X (the total distance between pouch side edges 20, 22). For example, if X is 10 inches in length, A can be 3 inches and B can be 7 inches. Thus, in some embodiments, pouch inflation ports 19, 21 can be positioned such that the difference in distance between A and B is about 40% or less of the total distance between the side edges of the pouch; in some embodiments, about 30% or less; in some embodiments, about 25% or less; in some embodiments, about 20% or less; in some embodiments, about 15% or less; and in some embodiments, about 10% or less. Despite these suitable ranges, in some embodiments, pouch inflation ports 19, 21 can be positioned approximately equidistant between pouch side edges 20, 22 (i.e., wherein A is approximately equal to B). One of ordinary skill in the art would also recognize that in some embodiments, the presently disclosed subject matter includes embodiments wherein pouch inflation ports 19, 21 are not within the ranges disclosed above.

Although pouch inflation ports 19, 21 are depicted as a circular opening in the Figures, it is recognized that the inflation ports can have any of a wide variety of shapes known in the art, including (but not limited to) trapezoidal, square, oblong, slit, and the like, so long as it allows contact with an inflation assembly, as set forth in more detail below. In addition, pouch inflation ports 19, 21 can be configured in any of a variety of sizes. In some embodiments, pouch inflation ports 19, 21 can be from about 0.25 to about 1.0 inches in diameter; in some embodiments, about 0.4 to about 0.6 inches in diameter; and in some embodiments, about 0.5 inches in diameter. One of ordinary skill in the art would also recognize that in some embodiments, the presently disclosed subject matter includes embodiments wherein pouch inflation ports 19, 21 are not within the ranges disclosed above.

In some embodiments, inflatable pouch 12 can comprise flap 28 positioned adjacent to pouch opening 26. Top edge 30 of flap 28 extends from rear sheet 18 beyond pouch opening 26. Flap 28 in some embodiments can merely be a continuous extension of rear sheet 18. Flap 28 has inner surface 34 facing in the direction of front sheet 16. In some embodiments, a sealing agent can be disposed at least partially on inner surface 34 of flap 28. In some embodiments, flap 28 can be perforated. As would be apparent to those of ordinary skill in the art, the sealing agent can comprise a variety of materials including (but not limited to) adhesive, paste, tape, and/or other similar materials that are suitable for sealing closed the opening of the pouch.

Figure 2D:
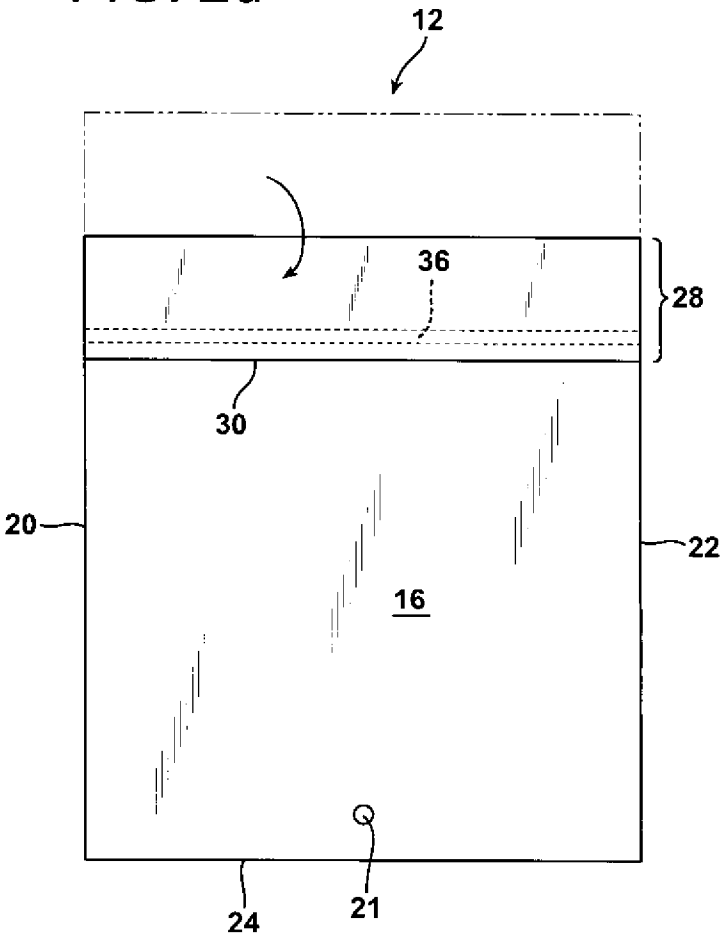
FIG. 2*d* is a top plan view of the outer pouch of FIG. 2*a* after the flap has been closed and adhered to the outside surface of the pouch.
Figure 2C:
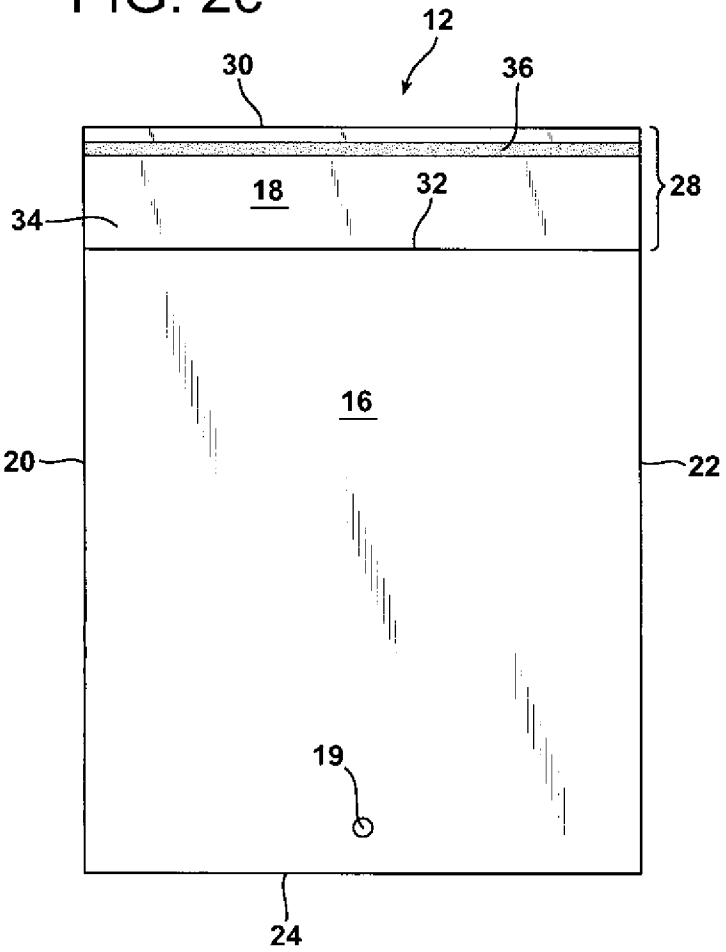
FIG. 2*c* is a top plan view of the outer pouch of FIG. 2*a* just prior to sealing the flap.

Pouch 12 can also comprise release liner 38 for protecting the sealing agent from premature contact with objects or other portions of the mailer. In this regard, FIG. 2*a* illustrates an inflatable mailer comprising release liner 38 covering the sealing agent. Release liner 38 is releasably adhered to the sealing agent and protects it before use. At a desired time, release liner 38 can be removed to expose sealing agent 36, as illustrated in FIG. 2*c*. Pouch opening 26 can then be sealed closed by folding flap 28 and pressing the sealing agent into sealing contact with the outer surface of front sheet 16, as depicted in FIG. 2*d*.

The material from which pouch 12 can be formed comprises a wide variety of materials known in the art, including (but not limited to) thermoplastic material, cardboard, paperboard, paper, foil, canvas, cloth, foamed film, and the like. In some embodiments, front and rear sheets 16, 18 of the pouch comprise flexible films, each of which includes a heat sealable thermoplastic material forming at least one surface of the film. The films can then be positioned with their thermoplastic surfaces in a face-to-face orientation. In some embodiments, the outer pouch surface has writing and/or printing capabilities and/or will adhere to gum and water-based adhesives.

Figure 3B:
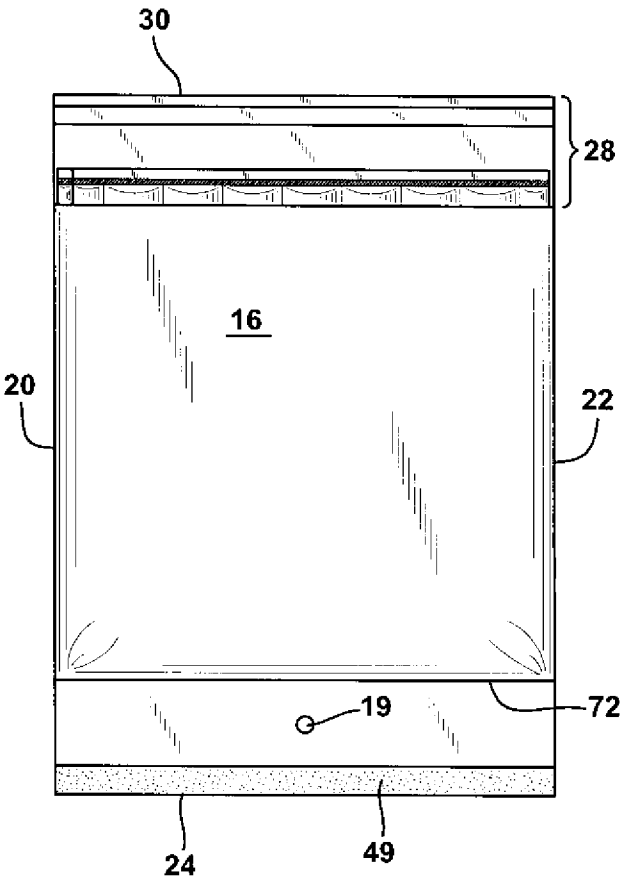
FIGS. 3*b* and 3*c* are top plan views of one embodiment of the mailer after inflation.
Figure 3A:
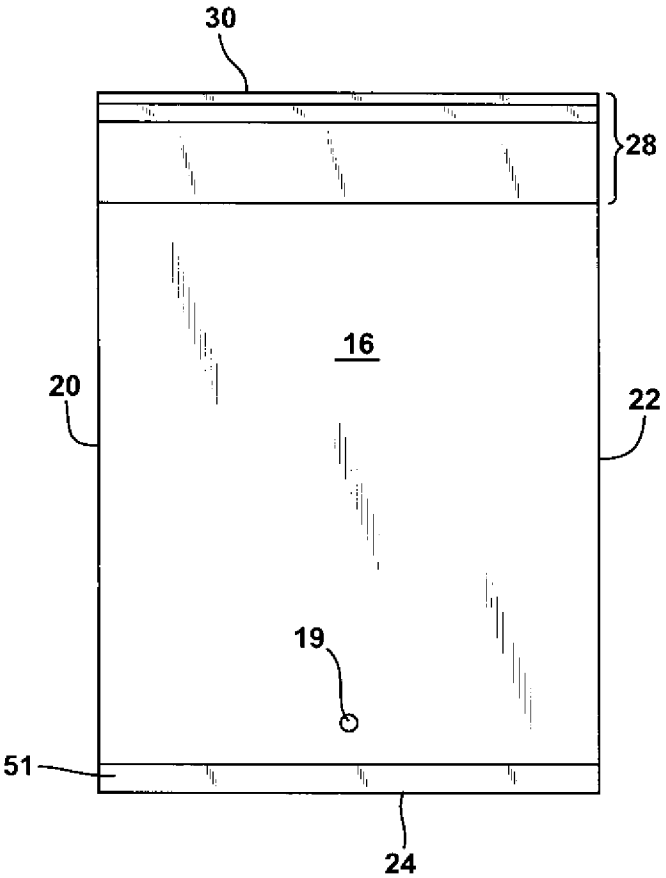
FIG. 3*a* is top plan view of one embodiment of an outer pouch of the inflatable mailer.
Figure 3C:
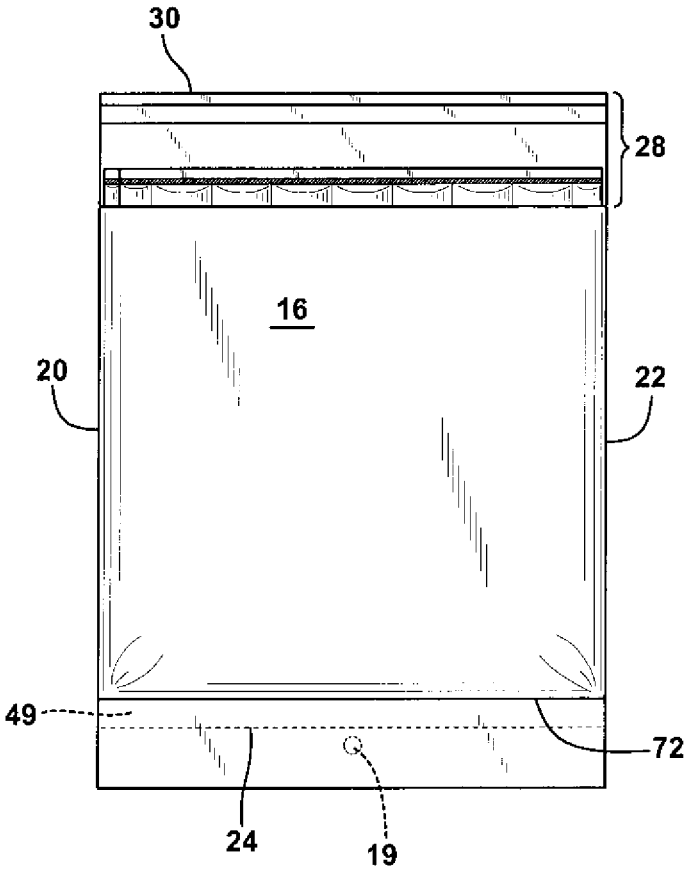

In some embodiments pouch 12 can comprise sealing agent 49 and release liner 51 positioned adjacent to bottom edge 24, as depicted in FIG. 3*a*. Release liner 51 is releasably adhered to the sealing agent and protects it before use. After inserting the liner into the pouch and inflating (as depicted in FIG. 3*b* and discussed herein below), the bottom mailer edge containing the inflation port and common channel can project from the inflated mailer area and can be a problem during the shipping cycle. To address the issue, a user can remove release liner 51 to expose sealing agent 49. The extended portion can then be adhered to the top sheet of the inflated mailer by pressing the sealing agent into contact with the outer surface of the inflated mailer, as depicted in FIG. 3*c*.

III.B. Inflatable Liner 14

Figure 4A:
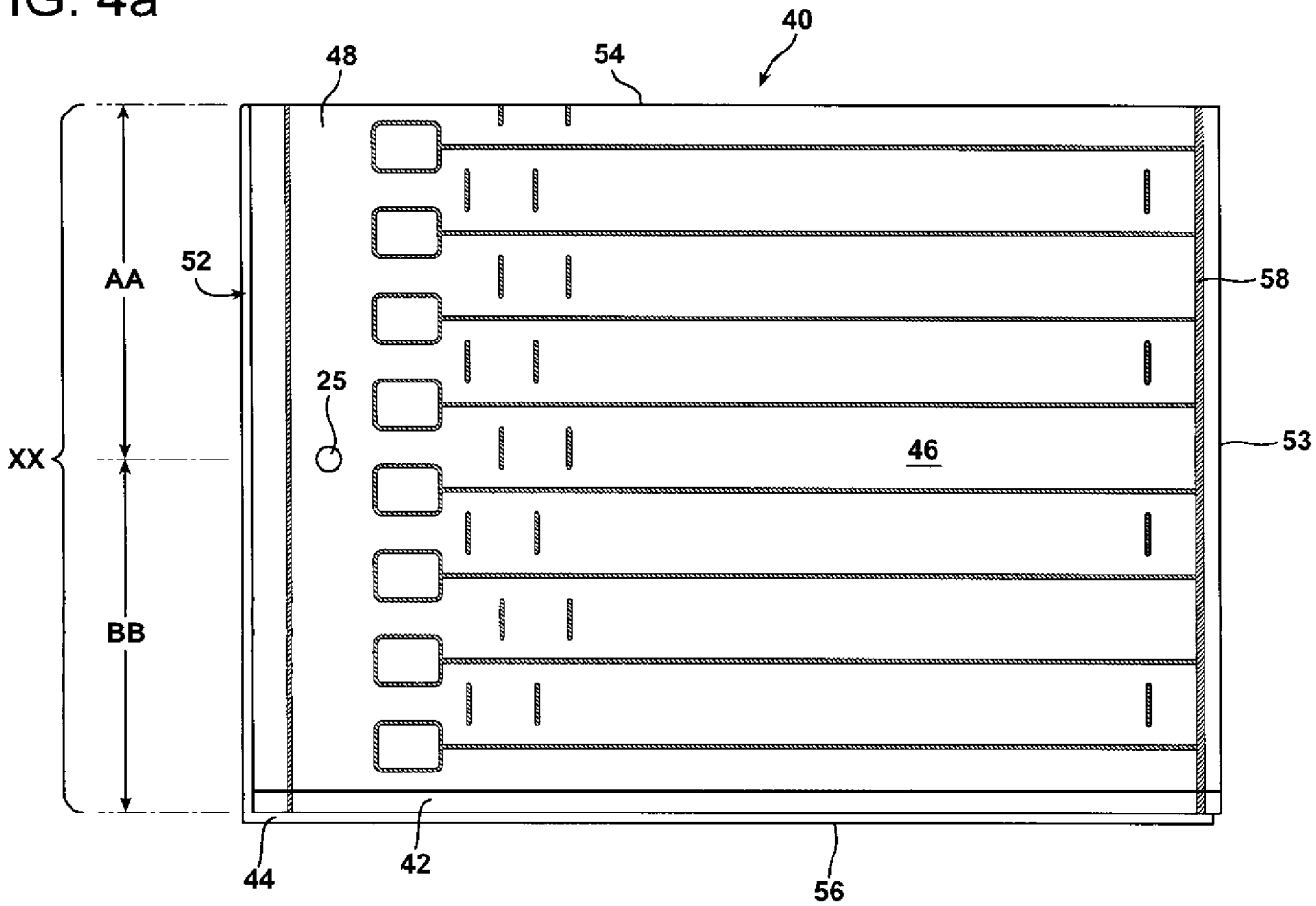
FIG. 4*a* is a top plan view of one embodiment of an inflatable web that can be used to construct the liner.

Inflatable liner 14 is disposed within the interior space of the pouch. The liner comprises a web that can be inflated to provide cushioning and to protect articles during shipment. In some embodiments, liner 14 can comprise front and rear webs that are oriented in face-to-face relation. As depicted in FIG. 4*a*, each inflatable web 40 comprises a top edge, a bottom edge, and opposite side edges, wherein the side edges of the front and rear webs are interconnected and at least one of the top or bottom edges are at least partially connected. In some embodiments, each inflatable web comprises two sheets 42 and 44 having respective inner surfaces that are attached to each other in pattern 58 defining a series of inflatable channels 46 and at least one common channel 48 in fluid communication with the inflatable channels.

In some embodiments, pattern 58 includes uninflated planar regions between the inflatable chambers to define the inflatable channels. Sheets 42 and 44 are oriented face-to-face and affixed to each other at top edge 53, bottom edge 52, and opposite side edges 54 and 56 using methods well known in the art. Particularly, the edges can be attached to each other using a variety of bonding techniques including, for example, heat seal or adhesive. Heat seals are preferred and, for brevity, the term "heat seal" is generally used hereinafter. This term should be understood to include the formation of seals by adhesion of edges 52, 53, 54, and 56 of sheets 42 and 44 to each other with an adhesive, thermal, ultrasonic fusion, radio frequency, and/or other suitable sealing methods.

Figure 4B:
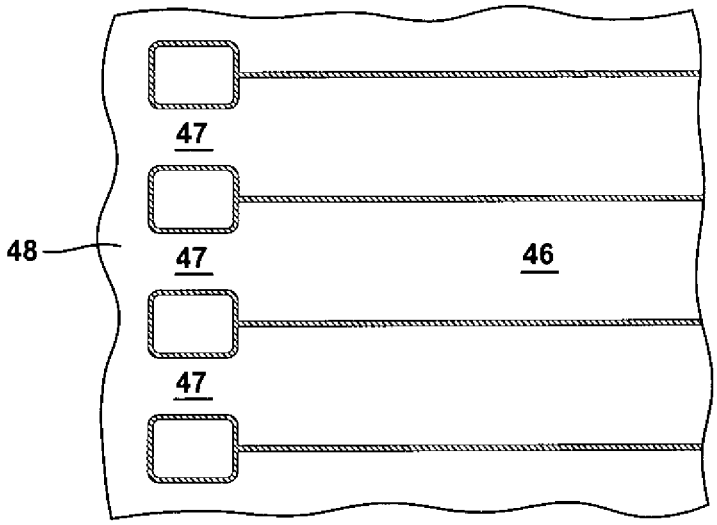
FIGS. 4*b* and 4*c* are enlarged fragmentary views of two embodiments of a web used to construct the liner.
Figure 4C:
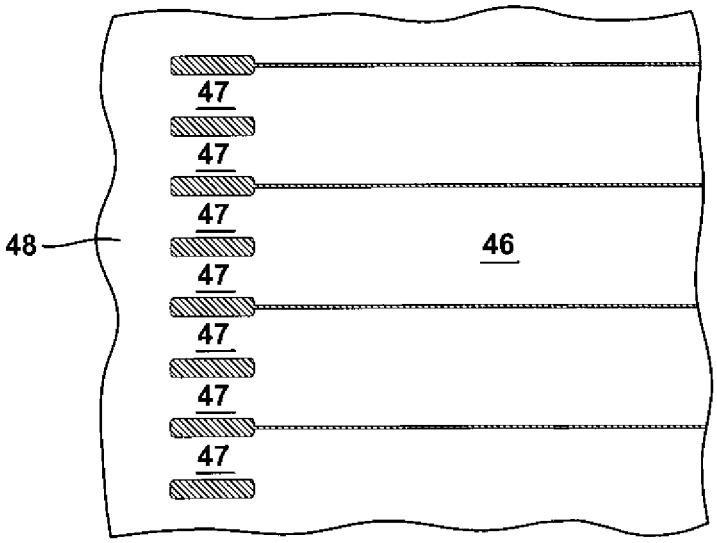

In some embodiments, channels 46 are connected to common channel 48 through at least one neck 47 to enable independent inflation. Each neck 47 is a narrowed region located between the common channel and each inflatable channel of the liner. The necks allow the gas from the inflation source to readily enter the inflatable channels from the common channel. FIG. 4*b* is a fragmented view of inflatable liner 40 illustrating a single neck embodiment, wherein one neck 47 is provided between each channel 46. Similarly, FIG. 4*c* is a fragmented view of inflatable liner 40 illustrating a double neck embodiment wherein two necks 47 are provided between each channel 46.

Sheets 42 and 44 can comprise two separate sheets, or alternatively, a single sheet that has been center-folded at one edge. In embodiments wherein a single sheet is center-folded to create the web, the folded edge, instead of being formed via heat seal or other suitable means, is simply the fold in the original sheet.

Sheets 42 and 44 can, in general, comprise any flexible material that can be manipulated to enclose a gas in channels 46 as herein described, including various thermoplastic materials, e.g., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers.

Ethylene/alpha-olefin copolymers are copolymers of ethylene with one or more comonomers selected from $C_3$ to $C_{20}$ alpha-olefins, such as 1-butene, 1-pentene, 1-hexene, 1-octene, methyl pentene and the like, in which the polymer molecules comprise long chains with relatively few side chain branches, including linear low density polyethylene (LLDPE), linear medium density polyethylene (LMDPE), very low density polyethylene (VLDPE), and ultra-low density polyethylene (ULDPE). Various other materials are also suitable such as, e.g., polypropylene homopolymer or polypropylene copolymer (e.g., propylene/ethylene copolymer), polyesters, polystyrenes, polyamides, polycarbonates, etc. The film can be monolayer or multilayer and can be made by any known coextrusion process by melting the component polymer(s) and extruding or coextruding them through one or more flat or annular dies.

In some embodiments, the liner (and/or pouch) can comprise one or more barrier layers. As used herein the term "barrier layer" refers to a property that indicates that the particular material has very low permeability to gases, such as oxygen. Suitable barrier materials can include (but are not limited to) ethylene/vinyl alcohol copolymer (EVOH), polyvinylidene dichloride (PVDC), vinylidene chloride copolymer such as vinylidene chloride/methyl acrylate copolymer, polyamide, polyester, polyacrylonitrile (available as Barex™ resin), or blends thereof. Oxygen barrier materials can further comprise high aspect ratio fillers that create a tortuous path for permeation (e.g., nanocomposites). In some embodiments, the oxygen barrier of materials can be further enhanced by the incorporation of an oxygen scavenger. In some embodiments, metal foil, metallized substrates (e.g., metallized polyethylene terephthalate (PET), metallized polyamide, and/or metallized polypropylene), and/or coatings comprising SiOx or AlOx compounds can be used to provide barrier properties. Such barrier layers are well known to those of ordinary skill in the art.

In some embodiments, the liner (and/or the pouch) comprises one or more antistatic film materials. Such antistatic agents include materials that can be processed into polymer resins and/or sprayed onto materials or articles to improve conductive properties and/or overall physical performance. Suitable antistatic materials can include (but are not limited to) glycerol monostearate, glycerol distearate, glycerol tristearate, ethoxylated amines, primary, secondary and tertiary amines, ethoxylated alcohols, alkyl sulfates, alkylarylsulfates, alkylphosphates, alkylaminesulfates, alkyl sulfonate salts such as sodium stearyl sulfonate, sodium dodecylbenzenesulfonate or the like, quaternary ammonium salts, quaternary ammonium resins, imidazoline derivatives, sorbitan esters, ethanolamides, betaines, or the like, and/or combinations thereof. Such antistatic agents are well known to those of ordinary skill in the art.

In some embodiments, sheets 42 and 44 comprise a thermoplastic heat sealable polymer on their inner surfaces such that, after superposition of the sheets, a web can be formed by passing the superposed sheets beneath a sealing roller having heated areas that correspond in shape to the desired pattern of seals 58. The sealing roller applies heat and forms seal pattern 58 between sheets 42 and 44 to thereby form channels 46 and common channel 48 with a desired shape. Alternatively, the web can be formed with a flat heated stamping mold, as known to those of ordinary skill in the art. Further details concerning the disclosed construction of web 40 are disclosed in U.S. Pat. No. 7,220,476 to Sperry et al. and in U.S. Pat. No. 6,800,162 to Goff, the entire disclosures of which are incorporated herein by reference.

Each web 40 comprises at least one liner inflation port 25 disposed in at least one of the two sheets in at least one of the two webs. Particularly, liner inflation port 25 can span at least one layer of one or both sheets 42, 44 to allow communication between an inflation means and liner 14 once inserted into the pouch. Thus, in some embodiments, the inflation ports span all layers of the inflatable liner. The liner inflation port in the web creates an inflation pathway through which a portion of gas can be introduced into said inflatable liner. Liner inflation port 25 can be formed using any of a wide variety of methods known in the art, including the use of an air-activated hole punch cylinder, rotary cutter, press cutter, punch and rotary anvil combination, and/or knife (including a star knife to form a multi-cross hatched slit). Such methods are well known to those of ordinary skill in the art.

As depicted in FIG. 4*a*, in some embodiments, liner inflation port 25 can be positioned in close proximity to bottom edge 52 and approximately equidistant from side edges 54, 56. For example, as depicted in FIG. 4*a*, "XX" represents the total distance between side edges 54, 56. "AA" represents the horizontal distance between liner inflation port 25 and side edge 54, and "BB" represents the horizontal distance between liner inflation port 25 and side edge 56. In some embodiments, liner inflation port 25 can be positioned such that the difference in distance between M and BB is 40% or less of XX (the total distance between side edges 54, 56). For example, if XX is 10 inches in length, AA can be 3 inches and BB can be 7 inches. Thus, in some embodiments, liner inflation port 25 can be positioned such that the difference in distance between AA and BB is about 40% or less of the total distance between the side edges of the liner; in some embodiments, about 30% or less; in some embodiments, about 25% or less; in some embodiments, about 20% or less; in some embodiments, about 15% or less; and in some embodiments, about 10% or less. Despite these suitable ranges, in some embodiments, liner inflation port 25 can be positioned approximately equidistant between side edges 54, 56 (i.e., wherein AA is approximately equal to BB). One of ordinary skill in the art would also recognize that in some embodiments, the presently disclosed subject matter includes embodiments wherein the liner inflation port is not within the ranges disclosed above.

Although liner inflation port 25 is depicted as a circular opening in the Figures, it is recognized that it can have any of a wide variety of shapes known in the art, including (but not limited to) trapezoidal, square, oblong, slit, and the like, so long as it allows contact with an inflation assembly, as set forth in more detail below. In addition, liner inflation port 25 can be configured in any of a variety of sizes. In some embodiments, liner inflation port 25 can be from about 0.25 to about 1.0 inches in diameter; in some embodiments, about 0.4 to about 0.6 inches in diameter; and in some embodiments, about 0.5 inches in diameter. One of ordinary skill in the art would also recognize that in some embodiments, the presently disclosed subject matter includes embodiments wherein the liner inflation port is not within the ranges disclosed above.

In some embodiments, at least one common channel extends laterally along one edge of the inflatable liner and is disposed adjacent to the bottom edge of the liner. As depicted in the Figures, common channel 48 provides an inflation pathway through which a gas can be introduced to fill the series of inflatable channels 46. Particularly, channels 46 are connected to common channel 48 through at least one neck to enable independent inflation. Since the inflatable channels are interconnected by the common channel, the volume of gas can be evenly distributed throughout the web. In some embodiments, seal pattern 58 can be heat seals between the inner surfaces of sheets 42, 44. Alternatively, sheets 42 and 44 can be adhesively bonded to each other to form the seal pattern. Heat seals are preferred and, for brevity, the term "heat seal" is generally used hereinafter. This term should be understood, however, to include the formation of seal pattern 58 by adhesion of sheets 42 and 44 as well as by heat sealing. Thus, common channel 48 functions to provide fluid communication between the liner inflation port(s) and the inflatable channels.

In some embodiments, inflatable liner 14 is uninflated prior to insertion into pouch 12. A controlled volume of gas is introduced into the inflatable liner after it is inserted into the pouch, but before common channel 48 is sealed, as set forth in more detail below. The distribution of gas from the common channel causes inflatable channels 46 to fill and expand. Movement of the gas through channels 46 is represented by the arrows in FIGS. 17*a* and 17*b*. After channels 46 are filled to a desired thickness, the web can then be sealed to prevent the escape of gas. Particularly, as depicted in FIG. 1*b* and discussed in more detail herein below, the mailer can be sealed with longitudinal seal 72 to prevent the escape of gas from channels 46.

In some embodiments, each of the inflatable channels 46 is a predetermined length that is substantially the same for each of the channels. For example, as shown in FIG. 4*a*, inflatable channels 46 are formed between sheets 42 and 44 such that the channels extend longitudinally across the inflatable web in a linear orientation that is substantially parallel to edges 54, 56. However, the presently disclosed subject matter is not limited to the inflatable channel structure set forth in FIG. 4*a*. Rather, channels 46 can comprise a wide variety of configurations known to those of ordinary skill in the art, so long as the channels are in fluid connection with common channel 48.

Figure 5B:
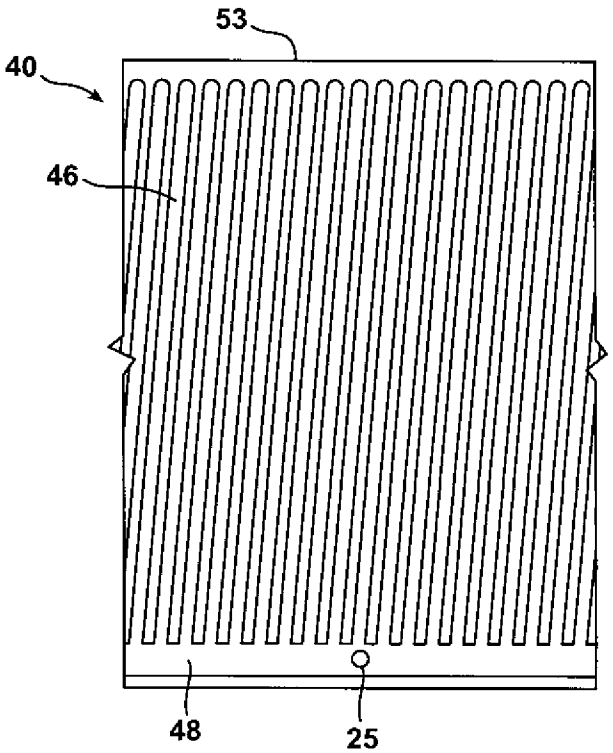
FIGS. 5*a*-5*d* are graphical illustrations of various embodiments of inflatable webs having seal patterns of varying designs.
Figure 5A:
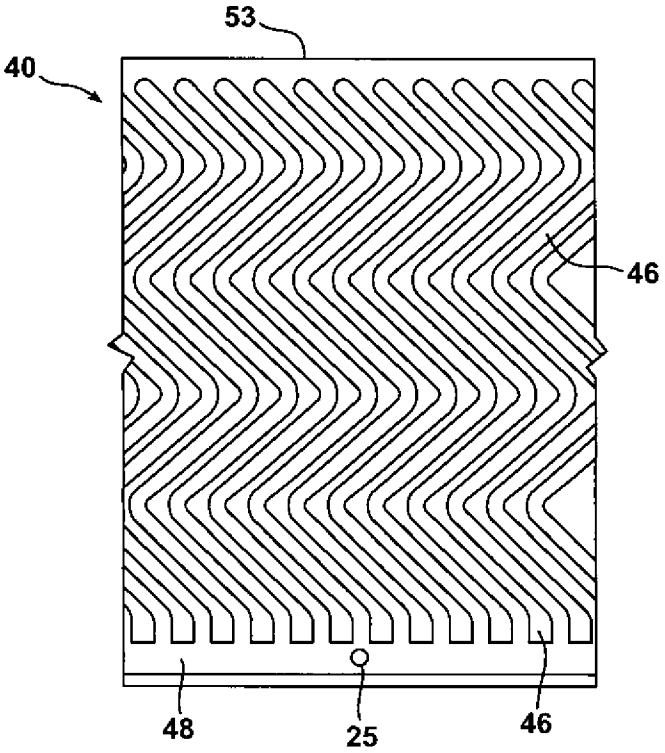
Figure 5D:
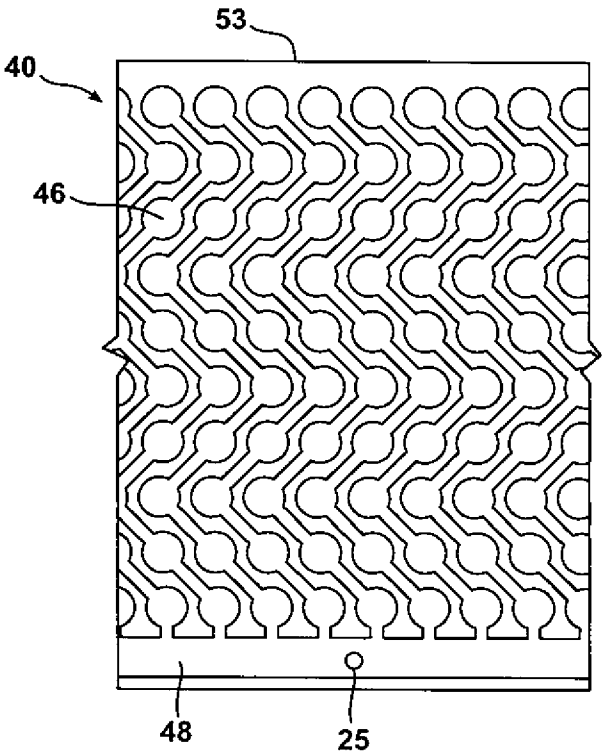
Figure 5C:
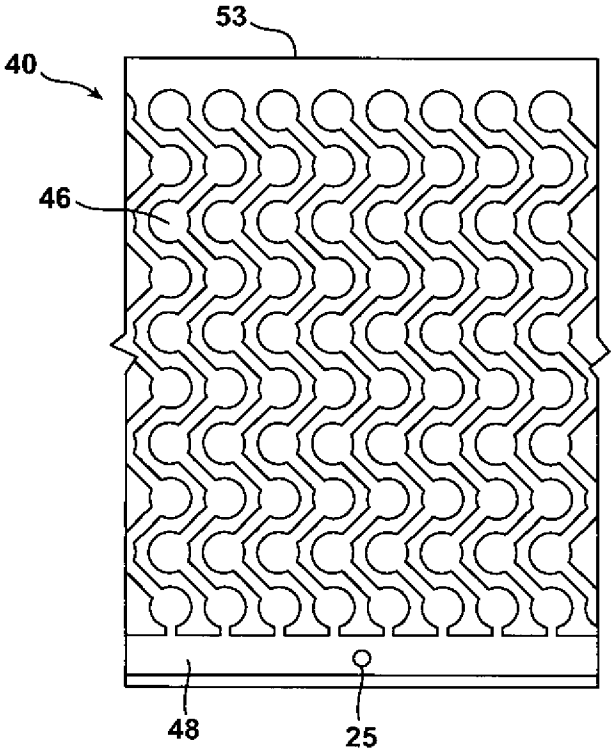

For example, FIGS. 5*a*-5*d* illustrate alternate embodiments of web 40 comprising different inflatable channel configurations. Particularly, FIGS. 5*a* and 5*b* illustrate that channels 46 can comprise successive non-linear and linear inflatable narrow channels having no change in width along their length. In the event that any one of the channels of FIG. 5*a* or 5*b* becomes deflated, the amount of unprotected space is relatively small. Alternatively, the embodiments set forth in FIGS. 5*c* and 5*d* illustrate that the inflatable channels can be non-linear and can oscillate with respect to the edges, with a bubble disposed at the apex and valley of each oscillation. One of ordinary skill in the packaging art would recognize that web 40 is not limited to the embodiments set forth herein, but can also include any of a wide variety of channel designs known in the art of inflatable packaging.

Figure 6A:
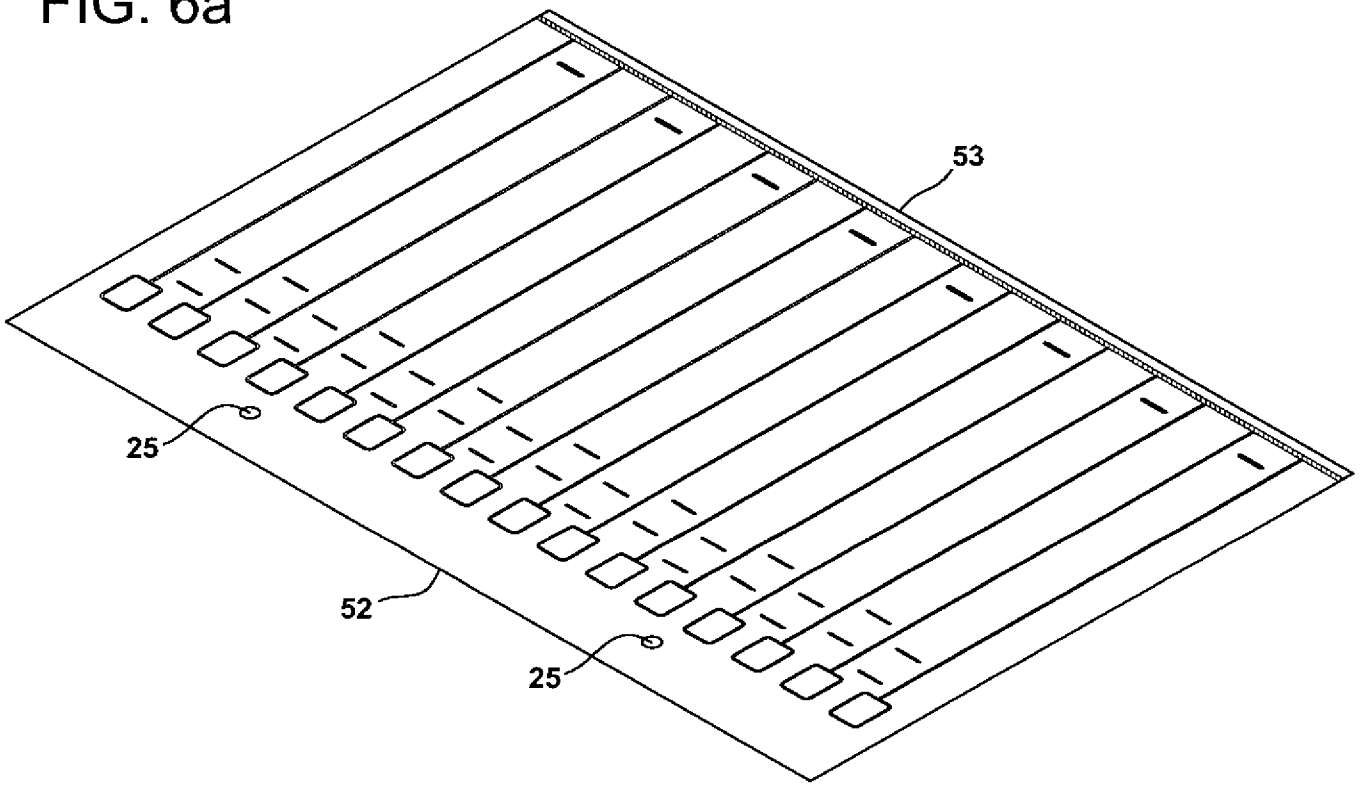
FIG. 6*a* illustrates one embodiment of an inflatable web cut to desired dimensions.
Figure 6B:
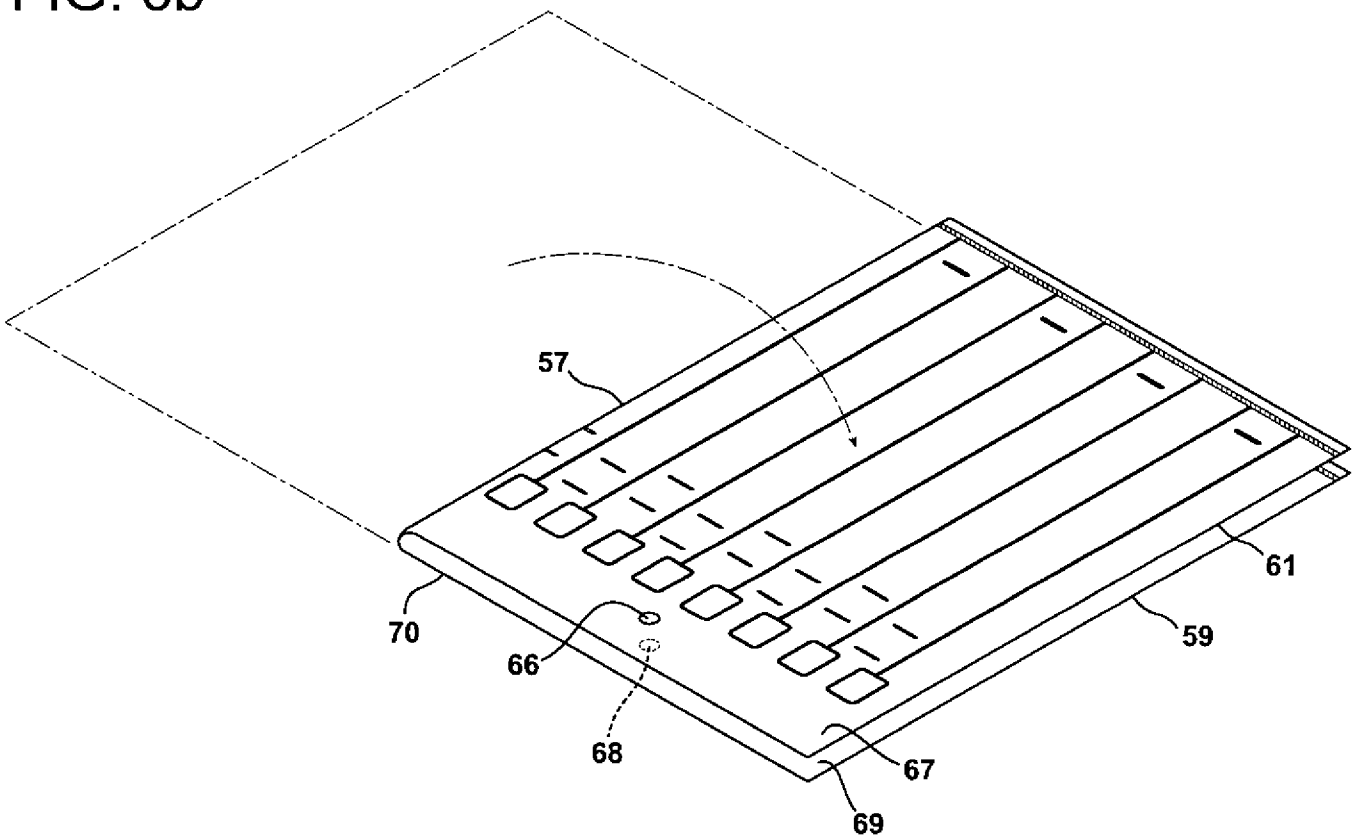
FIG. 6*b* illustrates one embodiment of the inflatable web of FIG. 6*a* folded into a liner.

FIGS. 6*a* and 6*b* illustrate one method that can be used to construct liner 14 from web 40. Particularly, as depicted in FIG. 6*a*, a length of web 40 is measured and cut to desired dimensions. In some embodiments, the length of web is cut so that it contains two liner inflation ports 25 that can be aligned with each other (and/or with the pouch inflation ports). Thus, although the pouch inflation ports may or may not be aligned with each other, the liner inflation ports must align with the pouch inflation ports to allow inflation of the liner.

As depicted in FIG. 6*b*, the length of measured web can then be folded over on itself at edge 57 such that the liner inflation ports are aligned. In some embodiments, after folding, the liner will contain upper and lower liner layers 67 and 69, and upper and lower liner inflation ports 66 and 68. Because liner inflation port 25 of web 40 can span both sheets 42, 44 of the web, in some embodiments upper and lower liner inflation ports 66, 68 can span all 4 layers of material (i.e., upper and lower sheets 42, 44 of upper and lower liner layers 67, 69). Alternatively, in embodiments wherein liner inflation port 25 of web 40 spans only one of sheets 42, 44, upper and lower liner inflation ports 66, 68 span only the top and bottom of the 4 layers of material (i.e., spanning upper sheet 42 of upper liner layer 67 and lower sheet 44 of lower liner layer 69).

After folding web 40 on itself as depicted in FIG. 6*b*, liner edge 59 is then sealed with edge seal 61 using conventional means known to those of ordinary skill in the art, such as heat seal and/or adhesives to form a tube. It should be recognized that the folding of web 40 is only one means of constructing liner 14. For example, in some embodiments, two lengths of web can be measured and cut to desired dimensions and then sealed along liner edges 57, 59.

Figure 6C:
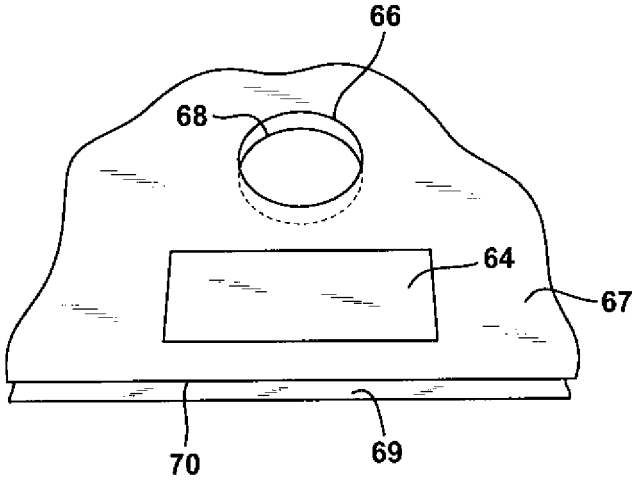
FIG. 6*c* is an enlarged fragmentary view of one embodiment of the folded web of FIG. 6*b*.

FIG. 6*c* is a cut away view of the liner of FIG. 6*b*. In some embodiments, spot seal 64 can be positioned between upper and lower liner layers 67 and 69 to secure and/or align the inflation ports. In some embodiments, the spot seal can be positioned on each layer between liner inflation ports 66, 68 and liner bottom edge 70. Spot seal 64 can be formed by thermal welds or adhesives to inhibit packaged items from sliding too far toward the liner inflation ports and interfering with the sealing process. Such spot seals are well known to those in the packaging art. See, for example, U.S. Pat. No. 6,182,426 to Pritchard, the entire disclosure of which is hereby incorporated by reference. One of ordinary skill in the art would appreciate that two or more spot seals can be used in place of the single spot seal of FIG. 6*c*. One of ordinary skill in the art would also appreciate that spot seal 64 is optional and the presently disclosed subject matter includes embodiments without such a spot seal. In some embodiments, the folded liner can then be positioned in pouch 12 so that upper and lower liner inflation ports 66, 68 of upper and lower liner layers 67, 69 are aligned with pouch inflation ports 19, 21.

To provide protection on all sides of a packaged article, the inflatable liner can be folded so that it covers the interior perimeter of the pouch. Generally, the thickness of liner 14 increases as it is inflated, resulting in a decrease in the width and length of the liner. To compensate for this decrease, the length of inflatable liner 14 positioned within the interior of pouch 12 is typically greater than the internal perimeter of the pouch. In this regard, FIGS. 8*a*-8*c* (discussed below) illustrate three folding methods that can be used to position the liner within the pouch. One of ordinary skill in the art would recognize that the presently disclosed subject matter is not limited to the folded embodiments set forth in FIGS. 8*a*-8*c*. Rather, any of a wide variety of folding patterns conventionally used in the art can be used.

Figure 7B:
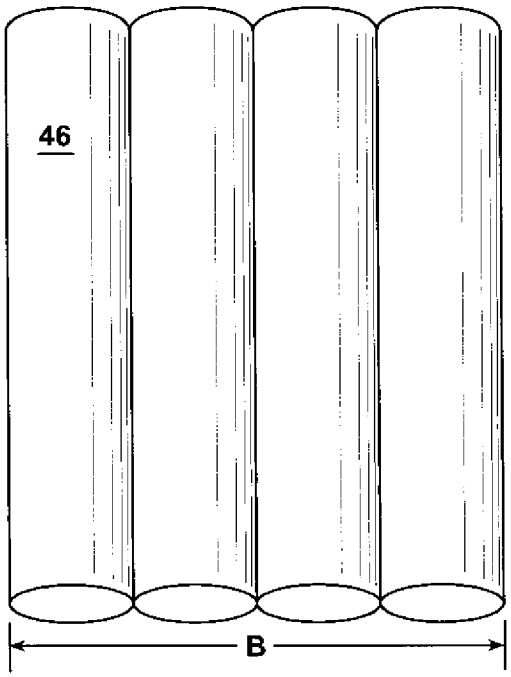
FIG. 7*b* is a top plan view of the liner of FIG. 7*a* after inflation.
Figure 7A:
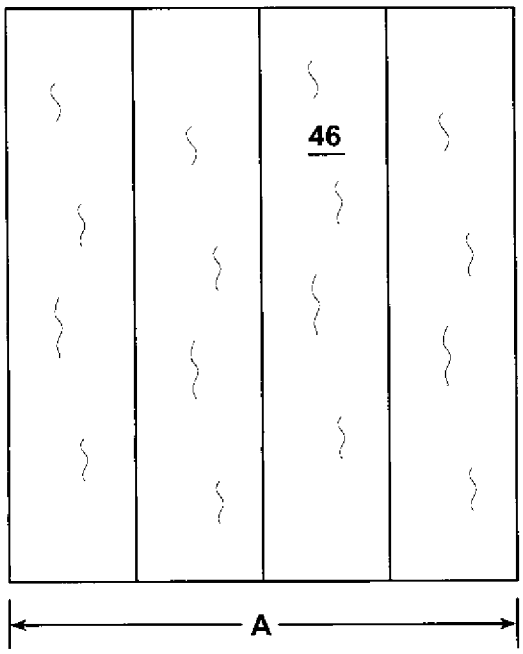
FIG. 7*a* illustrates one embodiment of an inflatable liner that can be used with the presently disclosed subject matter.
Figure 7D:
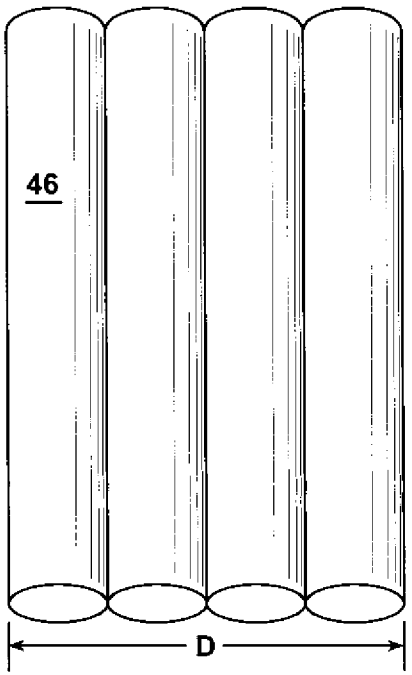
FIG. 7*d* is a top plan view of the liner of FIG. 7*c* after inflation.
Figure 7C:
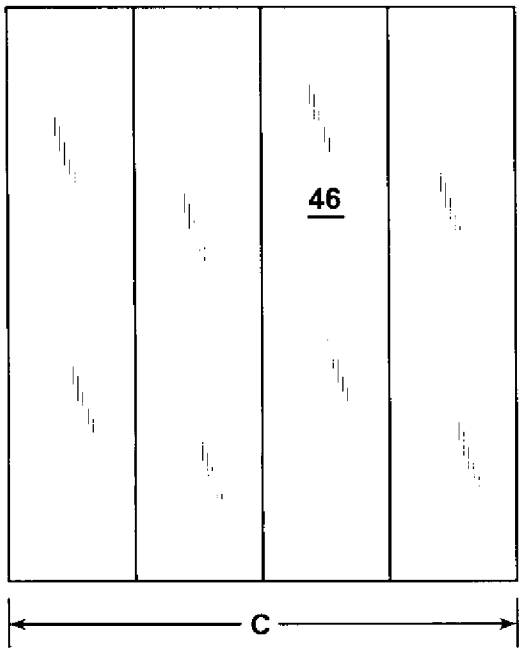
FIG. 7*c* illustrates one embodiment of an inflatable liner that can be used with the presently disclosed subject matter.

Alternatively, in some embodiments, the inflatable liner is not folded. In these embodiments, the liner is pre-formed and collapsed such that gussets and the like are not required to account for inflation. To elaborate, the inflatable liner can be formed like a bubble and collapsed. Particularly, the channels are thermoformed at least on one side using a vacuum. The channels can then be collapsed. As the liner is inflated, the thickness of the liner is increased. This can result in a minimal decrease in width of the liner. Thus, no gussets or other folds are required in these embodiments. For example, FIGS. 7*a* and 7*b* illustrate embodiments wherein the liner is pre-formed and collapsed. FIG. 7*a* illustrates channels 46 prior to inflation, with "A" representing the width of the liner. FIG. 7*b* illustrates the channels after inflation, with the width of the liner represented by "B". In these embodiments, "A" and "B" are approximately the same width, with only a minimal decrease (if any) in width in "B" compared to "A" as a result of inflation. In comparison, FIGS. 7*c* and 7*d* illustrate liners that have not been collapsed (such as those non-thermoformed liners discussed in detail herein above). The liners of FIGS. 7*c* and 7*d* benefit from gussets or other folds because the width of the uninflated liner of FIG. 7*c* ("C") is greater than the width of the inflated liner of FIG. 7*d* ("D").

In some embodiments, liner 14 can comprise at least one gusset fold. In FIG. 8*a*, inflatable liner 14 includes two gusset folds 71, 73. The gussets allow the width of the folded liner to fit into the interior perimeter of the pouch while allowing the length of the inflatable liner to be longer than the internal perimeter of the pouch. The gussets can be produced by any conventional method known to those of ordinary skill in the art. See, for example, U.S. Pat. No. 7,147,597 to Wilkes; U.S. Pat. No. 7,144,159 to Piotrowski; U.S. Pat. No. 7,048,442 to Schneider; and U.S. Pat. No. 6,957,915 to Tankersley, the entire disclosures of which are hereby incorporated by reference herein.

Figure 8B:
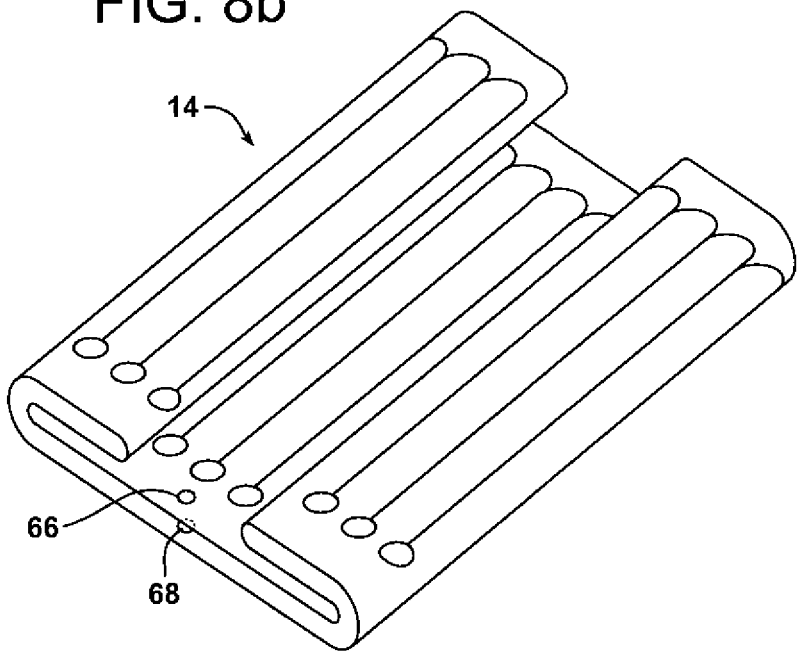
FIG. 8*b* is a perspective view of one embodiment of a c-folded liner.

In some embodiments, the liner can comprise at least one c-fold as illustrated in FIG. 8*b*. Particularly, FIG. 8*b* illustrates that liner 14 can be folded into a c-fold by folding one liner edge toward the centerline of the liner and also folding the opposite edge of the liner toward the centerline of the liner such that the two edges end up at or near the centerline on the same side of the liner.

Figure 8C:
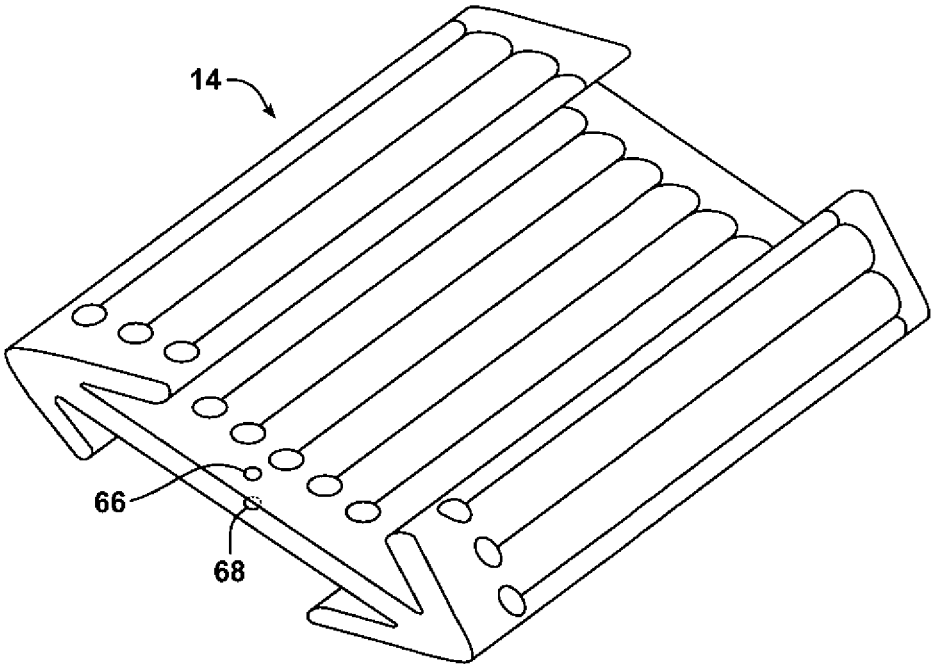
FIG. 8*c* is a perspective view of one embodiment of an arrow-folded liner.

In some embodiments, liner 14 can comprise at least one arrow fold as depicted in FIG. 8*c*. Specifically, liner 14 can be arrow folded by folding in half to form a triangle. The bottom point is then folded to meet the top point. The top layer is then folded downward to form the arrow-shape.

Figure 9A:
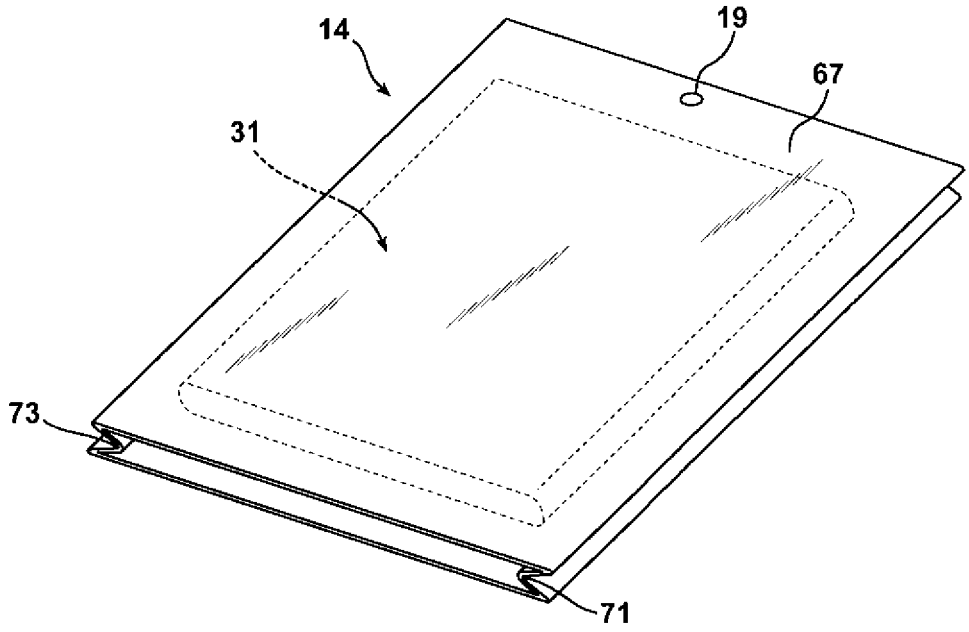
FIG. 9*a* is a top plan view of one embodiment of the disclosed liner.
Figure 9B:
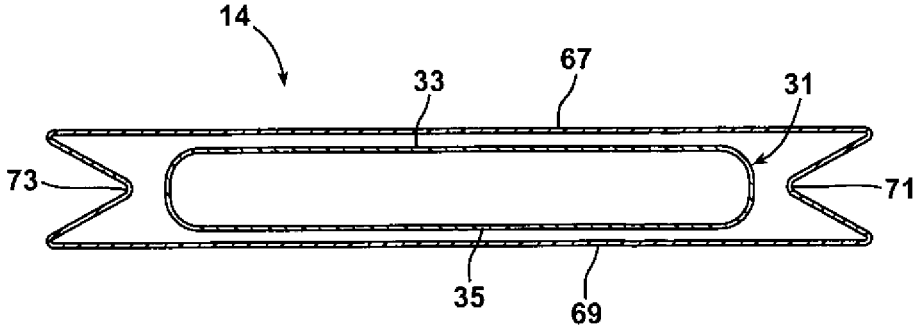
FIG. 9*b* is a front elevation view of the liner of FIG. 9*a*.

As depicted in FIGS. 9*a* and 9*b*, in some embodiments protective liner 31 can be introduced into the interior of the mailer (i.e., in between upper and lower liner layers 67, 69). In some embodiments, the protective liner can comprise a single film pouch, as are commonly known in the art. For example, as depicted in FIGS. 9*a* and 9*b*, protective liner 31 can comprise upper and lower layers 33, 35. The protective liner can be attached to at least one edge of the inner liner and/or the outer bag. The protective liner can protect the inflatable liner from damage resulting from the packaged article. For example, protective liner 31 can protect the inflated channels of inflatable liner 14 from puncture when packaging sharp objects. In addition, the protective liner can assist users in properly inserting an article into the liner.

In some embodiments, the liner can comprise at least one one-way valve. Particularly, in some embodiments, the one-way valve can be positioned within the common channel. In some embodiments, the one-way valve can extend through the outer pouch. Such one-way valves are known to those of ordinary skill in the art.

III.C. First Alternate Embodiment of Inflatable Liner 14

Figure 10A:
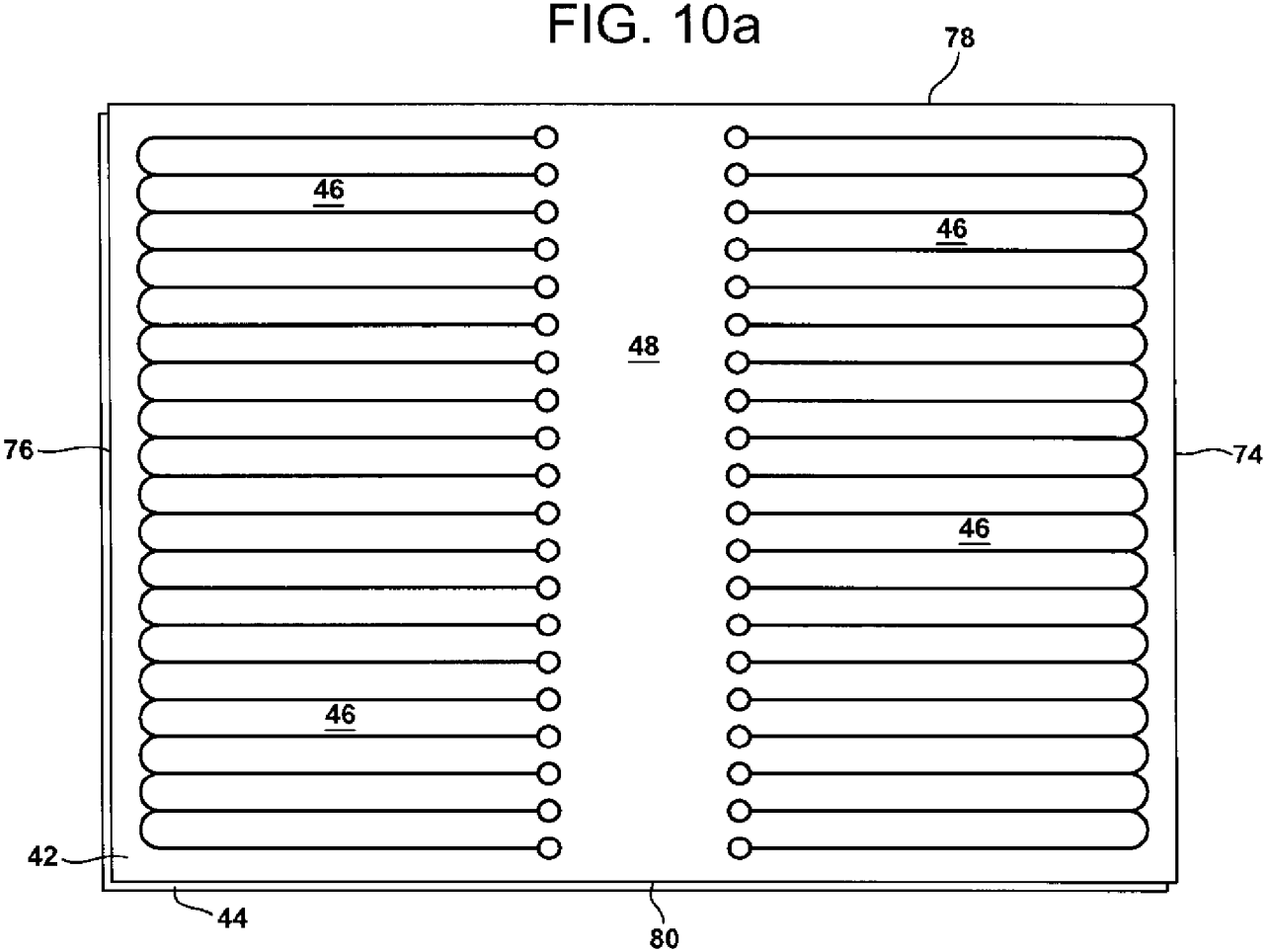
FIG. 10*a* is a top plan view of one embodiment of an inflatable web that can be used to construct the liner.

As depicted in FIG. 10*a*, in some embodiments, inflatable web 40 comprises two sheets 42 and 44 having respective inner surfaces that are attached together in a pattern defining a series of inflatable channels 46. The sheets are oriented face-to-face and affixed to each other at edges 74, 76, 78, and 80 using methods well known to those of ordinary skill in the art (i.e., heat seal and/or adhesive). In some embodiments, the web can be configured with common channel 48 positioned in the approximate midline of the web (i.e., approximately equidistant from edges 74, 76. Channels 46 thus are positioned on both sides of the common channel and extend horizontally to edges 74 and 76. As with the embodiments described above, the desired pattern of seals can be formed by passing the superposed sheets beneath a sealing roller or flat mold having heated areas that correspond in shape to the desired pattern of seals.

Figure 10B:
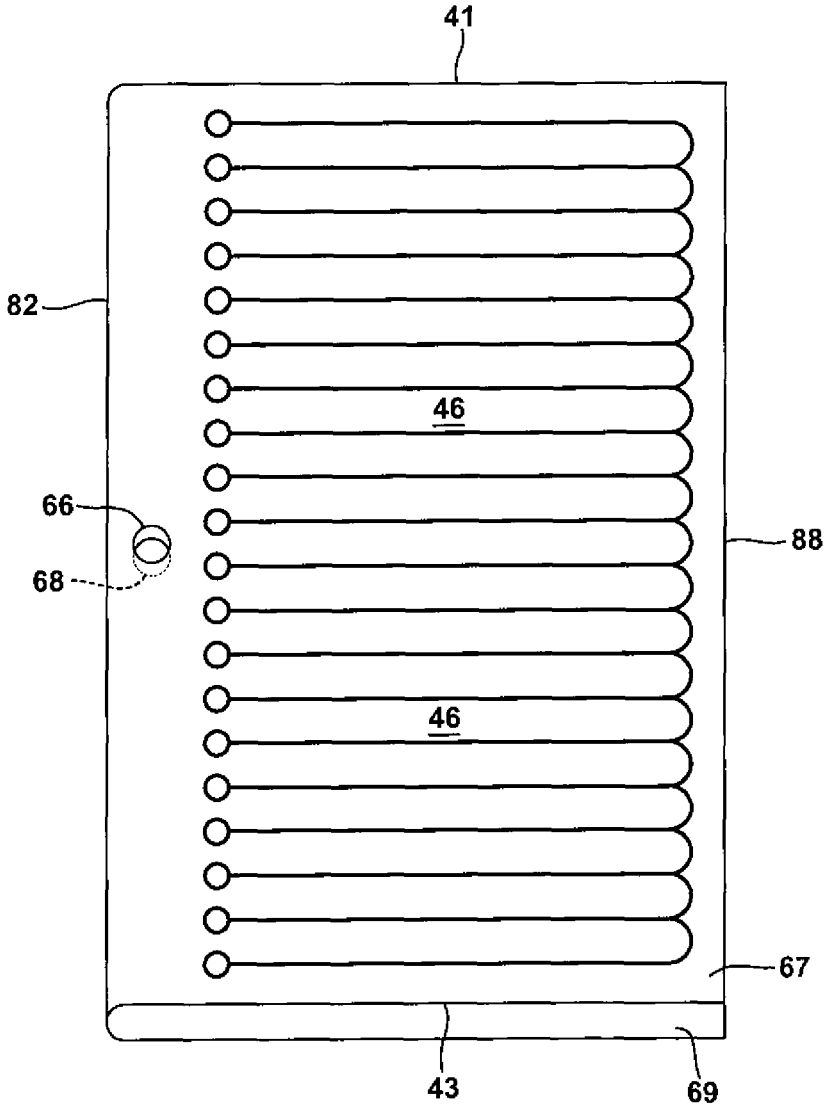
FIG. 10*b* is a top plan view of the inflatable web of FIG. 10*a* after it has been folded to form the liner.

A length of the web of FIG. 10*a* can be measured and cut to desired dimensions. The web is then folded over on itself at edge 82 as depicted in FIG. 10*b* to create upper and lower liner layers 67 and 69. The liner is then sealed along edges 41 and 43 using conventional means known to those of ordinary skill in the art, such as adhesives and/or heat seal.

One or more liner ports in upper liner layer 67 and/or lower liner layer 69 or all four layers can then be formed using any of a wide variety of methods known in the art, including the use of an air-activated hole punch cylinder, rotary cutter, press cutter, punch and rotary anvil combination, and/or knife (including a star knife to form a multi-cross hatched slit). Such methods are well known to those of ordinary skill in the art.

One benefit of using a liner design of the type depicted in FIG. 10*a* is that the liner contains a single manifold shared by both sides to allow for faster inflation. In addition, the liner contains a very simple construction and thus is more easily made compared to other liners known in the art.

III.D. Assembly of Mailer 10

Figure 11A:
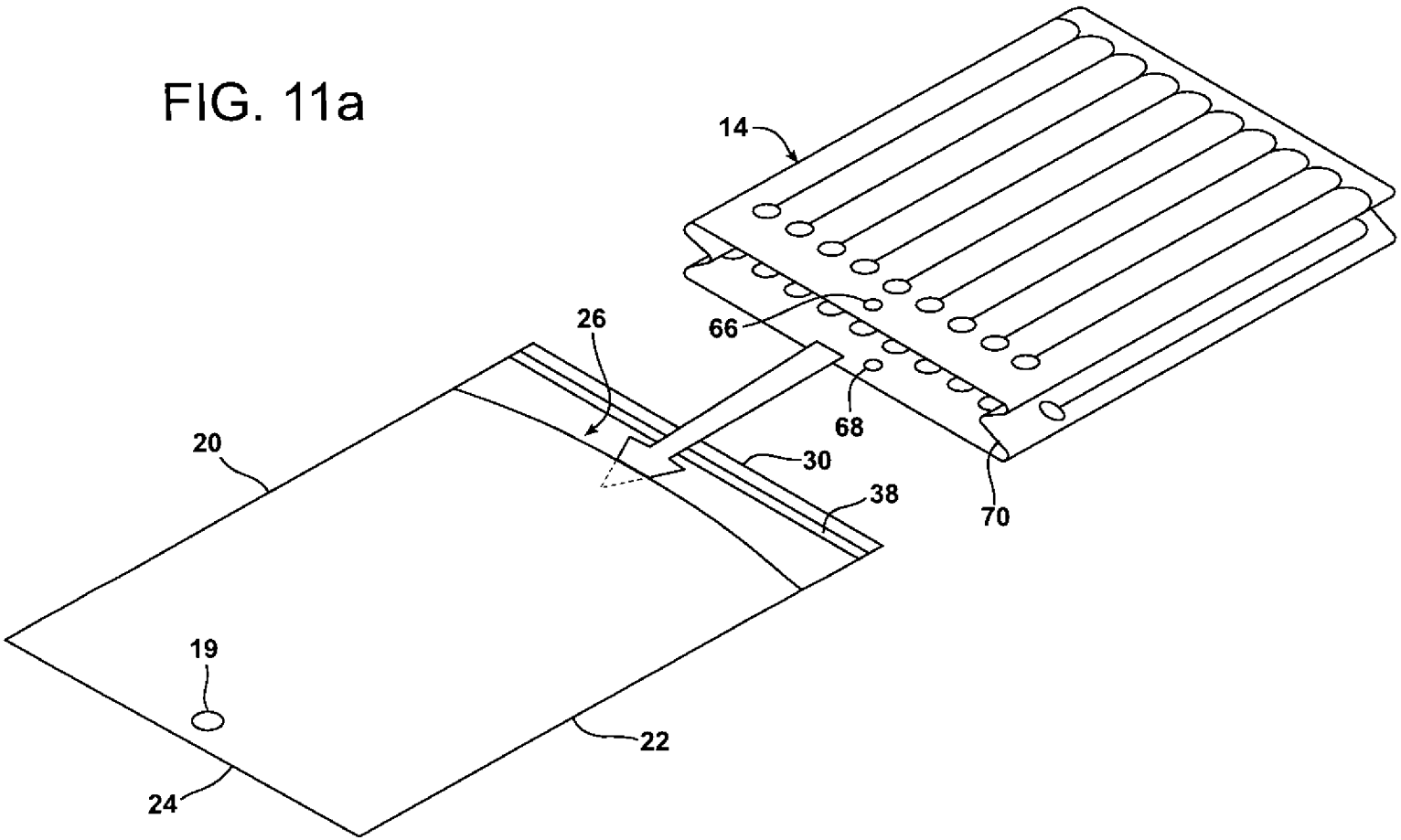
FIG. 11*a* is a top plan view illustrating one embodiment of the insertion of a liner into a pouch.
Figure 11B:
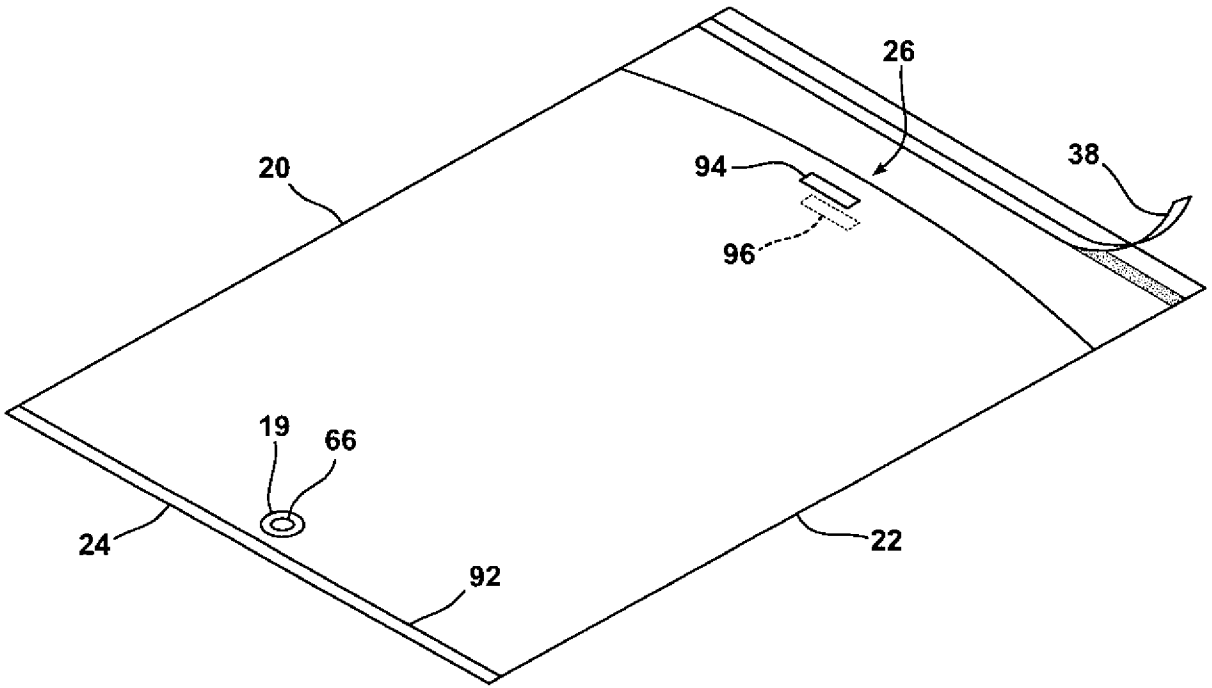
FIG. 11*b* is a top plan view of one embodiment of the assembled mailer of FIG. 11*a*.

After construction of pouch 12 and liner 14 as set forth in detail above, the liner is inserted manually or mechanically into the pouch, as depicted in FIG. 11*a*. Particularly, uninflated liner 14 is disposed into the interior space of the pouch through pouch opening 26 such that liner inflation ports 66, 68 and pouch inflation ports 19, 21 are aligned. Thus, although the pouch inflation ports may or may not be aligned with each other, the liner inflation ports must align with the pouch inflation ports to allow inflation of the liner. In some embodiments, once the pouch and liner inflation ports are aligned, liner 14 can be attached to the pouch along bottom edge 24 by attachment seal 92, as depicted in FIG. 11*b*. Attachment seal 92 can be constructed using methods well known in the art (i.e., heat sealing and/or adhesives). As also depicted in FIG. 11*b*, in some embodiments, pouch inflation ports 19, 21 are larger in size compared to liner inflation ports 66, 68 to allow for easier inflation of the liner. Particularly, in some embodiments it is desirable for the pouch inflation ports to be larger in size compared to the liner inflation ports to prevent misalignment during inflation. That is, in embodiments when the pouch inflation port is larger in size, the liner inflation port is ensured to have access to the inflation assembly. In addition, such a design also allows the liner to expand and touch against the inflation assembly during inflation.

In some embodiments, the assembled mailer can comprise spot seals 94, 96 positioned between the aligned pouch and liner. Particularly, as depicted in FIG. 11*b*, upper spot seal 94 can be positioned between top sheet 42 of upper liner layer 67 and pouch front sheet 16. Alternatively or in addition, lower spot seal 96 can be positioned between bottom sheet 44 of lower liner layer 69 and pouch rear sheet 18. Spot seals 94 and 96 can be formed by thermal welds or adhesives to ensure that the user correctly positions a packaged item in between the upper and lower liner layers instead of in between the liner and the pouch. Such spot seals are well known to those in the packaging art.

The article(s) to be packaged can then be manually or mechanically inserted into mailer 10 through opening 26 and in between the two webs of the liner. The mailer is then sealed by removing release liner 38 to expose sealing agent 36 of pouch flap 28. Pouch opening 26 can then be sealed closed by folding flap 28 and pressing the sealing agent into sealing contact with the outer surface of front sheet 16 (depicted in FIGS. 2*c* and 2*d*). It should be noted that there are embodiments wherein mailer 10 is configured without release liner 38. In such embodiments, sealing agent 36 can be an adhesive or other like materials. Alternatively, the mailer can be secured using standard adhesive means, such as packaging tape or heat seal. The closed mailer can then be forwarded to the disclosed inflation/sealer assembly discussed herein below.

Accordingly, in some embodiments, the presently disclosed subject matter comprises providing a pouch, providing an inflatable liner and disposing the inflatable liner into the interior space of the pouch, wherein the liner inflation ports are aligned with the pouch inflation ports. In some embodiments, an article is then inserted between the two webs of the liner, and the pouch opening is then closed. The liner can then be inflated. The front and rear webs of the inflatable liner can then be sealed together to close off the inflation ports from the inflatable channels in the liner and to thereby produce an inflated mailer. The article can then be shipped.

Alternatively, in some embodiments, the presently disclosed subject matter comprises providing a pouch, providing an inflatable liner and disposing the inflatable liner into the interior space of the pouch, wherein the liner inflation ports are aligned with the pouch inflation ports. The inflatable liner can then be inflated and the front and rear webs sealed together to close off the inflation ports from the inflatable channels to thereby produce an inflated mailer. In some embodiments, the article can then be inserted between the two webs of the liner and the pouch opening closed. The article can then be shipped.

The dimensions of mailer 10 can be varied depending upon its intended use. For instance, mailers for shipping larger objects will require a larger size pouch than mailers adapted for shipping smaller objects. Similarly, the thickness and impact absorbing capability of the liner can be increased or decreased by varying the volume of gas present in the liner. The volume of gas in the liner can be controlled by changing the volume of the inflatable channels during the manufacturing process, or by increasing or decreasing the amount of gas introduced into channels 46. In some embodiments, the thickness of the inflated liner is in the range of from about 0.5 to 3 inches; in some embodiments, about 0.75 to about 2.5 inches; and in some embodiments, about 1 to 2 inches.

III.E. Alternate Assembly of Mailer 10

Figure 12B:
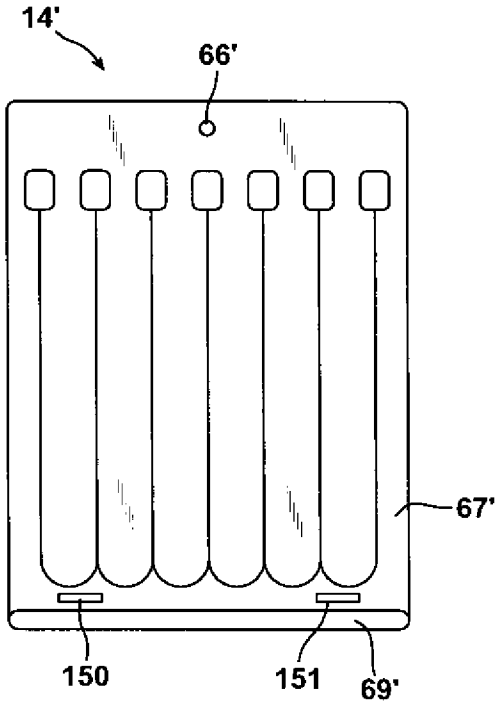
FIG. 12*b* is a top plan view of one embodiment of an inflatable liner of the presently disclosed subject matter.
Figure 12A:
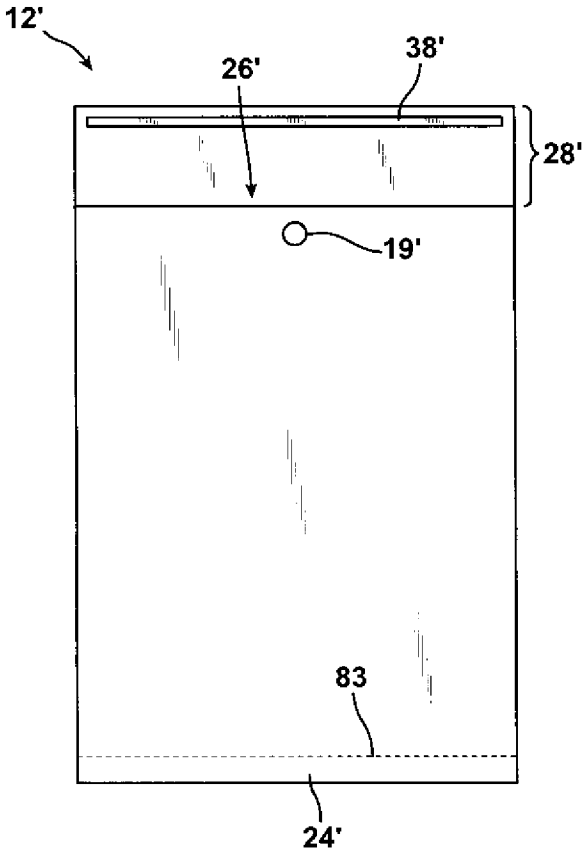
FIG. 12*a* is a top plan view of one embodiment of a pouch of the presently disclosed subject matter.

One of ordinary skill in the art would recognize that there are alternate embodiments to the assembly of mailer 10, such as that depicted in FIG. 12*a*. Particularly, in some embodiments, pouch inflation ports 19', 21' can be positioned on the top end of pouch 12', adjacent to flap 28' and pouch opening 26'. In addition, in some embodiments pouch 12' can comprise perforation line 83 positioned at or near pouch bottom edge 24' that spans from one pouch side edge to the other. Perforated line 83 can be formed using any of a wide variety of conventional methods known in the art.

As depicted in FIG. 12*b*, in some embodiments, liner 14' comprises liner inflation ports 66' and 68' positioned at the upper edge of the liner. In addition, the liner comprises spot seals 150 and 151 positioned at the bottom edge of the liner between upper and lower liner layers 67', 69'. Spot seals 150, 151 can be formed by thermal welds, adhesives, and/or other methods known to those of ordinary skill in the art. However, the spot seals are optional, and there are embodiments of the presently disclosed subject matter that do not include such spot seals.

Figure 12C:
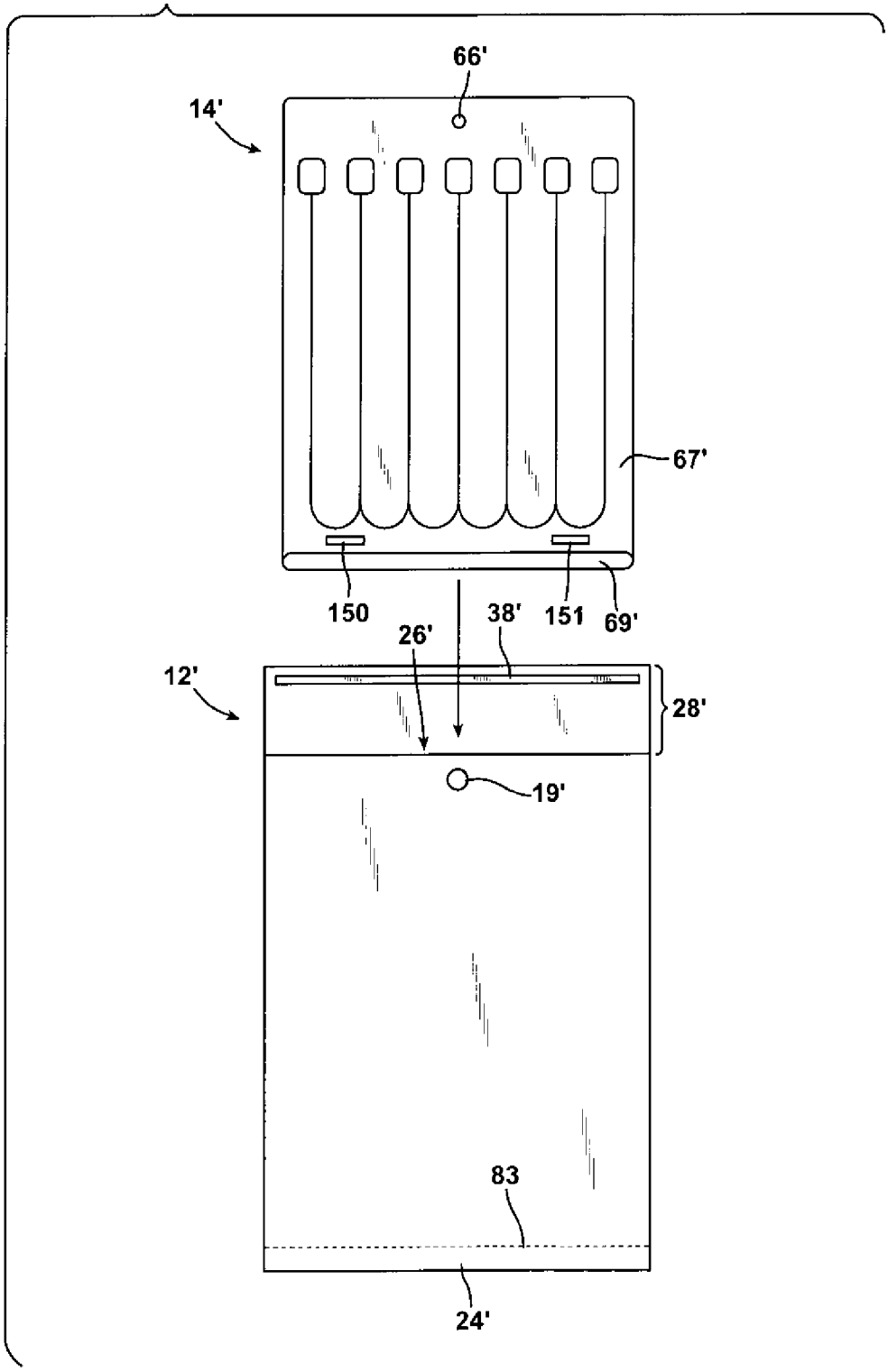
FIG. 12*c* is a top plan view illustrating the insertion of the liner of FIG. 12*b* into the pouch of FIG. 12*a*.

As depicted in FIG. 12*c*, uninflated liner 14' is then inserted into pouch opening 26' such that liner inflation ports 66', 68' and pouch inflation ports 19', 21' are aligned (i.e., liner 14' is oriented in the opposite direction from the embodiment of FIGS. 11*a* and 11*b*). The article to be packaged is then manually or mechanically inserted into mailer 10' through opening 26' and in between upper and lower liner layers 67' and 69'. The mailer can then be forwarded to the disclosed inflation/sealer assembly discussed herein below.

Figure 12E:
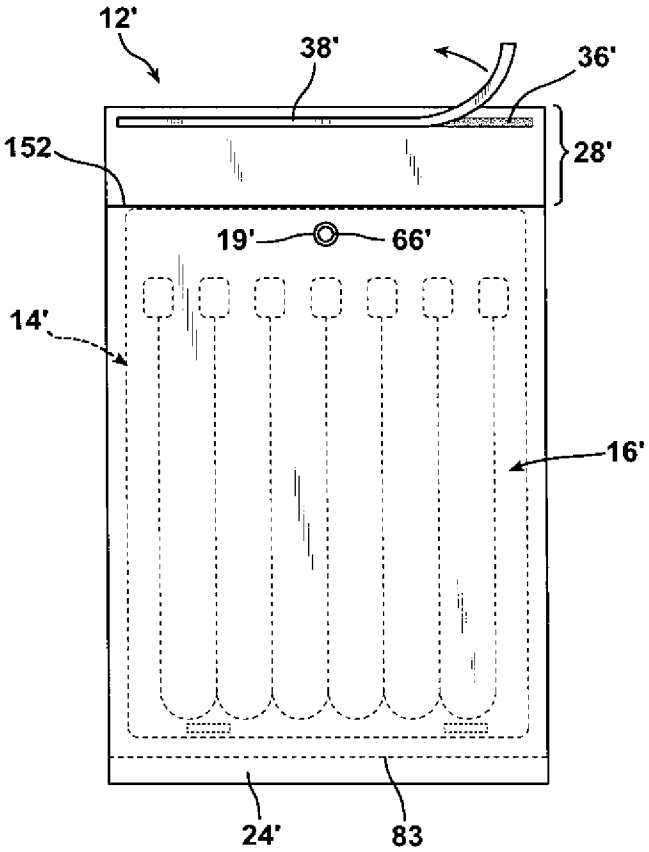
FIG. 12*e* is a top plan view of the inflated mailer of FIG. 12*d* after removal of the release liner.
Figure 12D:
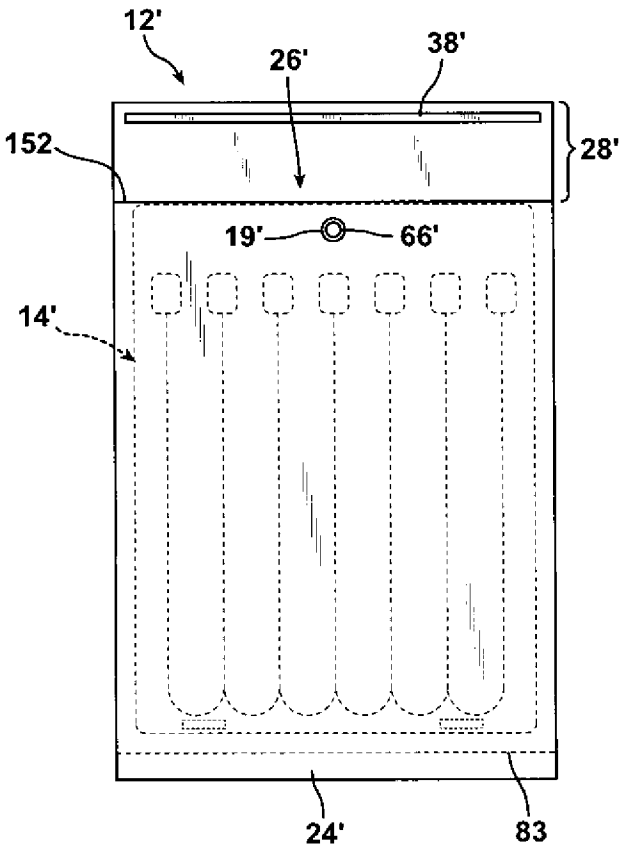
FIG. 12*d* is a top plan view of one embodiment of an inflated mailer.

FIG. 12*d* illustrates mailer 10' after inflation and heat sealing. Particularly, the mailer comprises heat seal line 152 that results from sealing the inflation ports from the inflated channels of the liner. To cover heat seal line 152 and the liner and mailer inflation ports, a user can then remove release liner 38' to expose sealing agent 36' of pouch flap 28' as illustrated in FIG. 12*e*. The sealing agent is then pressed into sealing contact with the outer surface of front sheet 16' as depicted in FIG. 12*f*. It should be noted that there are embodiments wherein mailer 10' is configured without release liner 38'. In such embodiments, sealing agent 36' can be an adhesive or other like materials. Alternatively, the mailer can be secured using standard adhesive means, such as packaging tape.

Figure 12G:
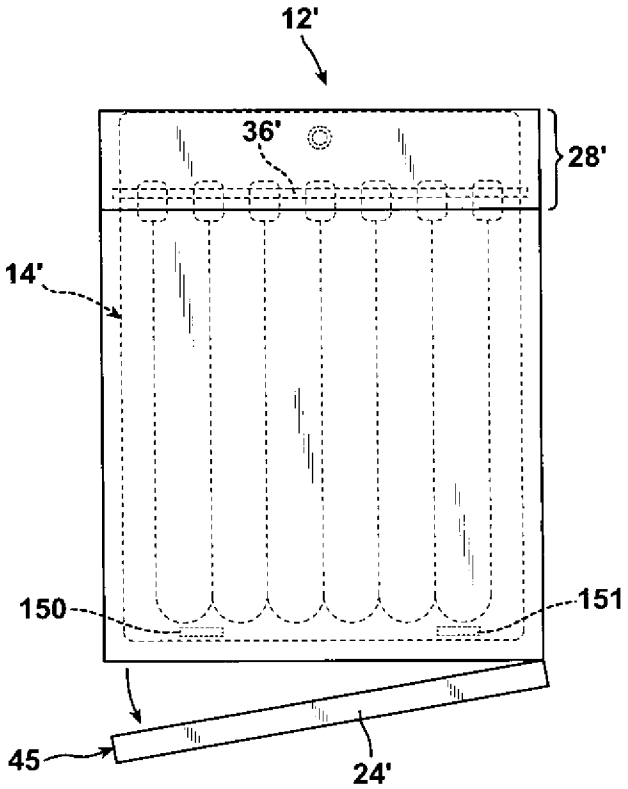
FIG. 12*g* is a top plan view of the inflated mailer of FIG. 12*f* after removal of the bottom perforated edge.
Figure 12F:
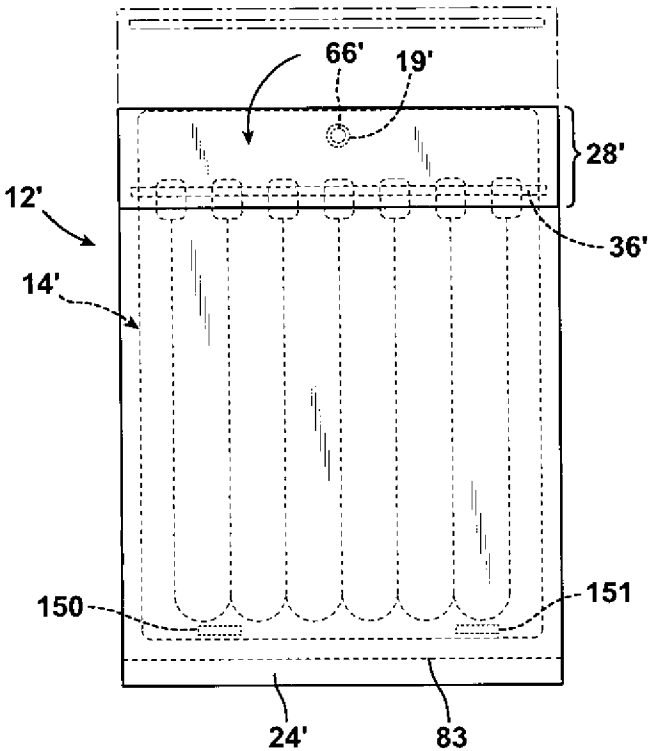
FIG. 12*f* is a top plan view of the inflated mailer of FIG. 12*e* after the flap has been folded and adhered to the outer pouch.

At a desired time (i.e., after the mailer has been received by the recipient in some embodiments), a user can open mailer 10' by applying pressure to perforated line 83 to remove portion 45 of the pouch in between the perforated line and bottom pouch edge 24', as depicted in FIG. 12*g*. The user can then break spot seals 150 and 151 by exerting minimal pressure to access the packaged product.

IV. Inflation/Seal Assembly 102

IV.A. Generally

Figure 13A:
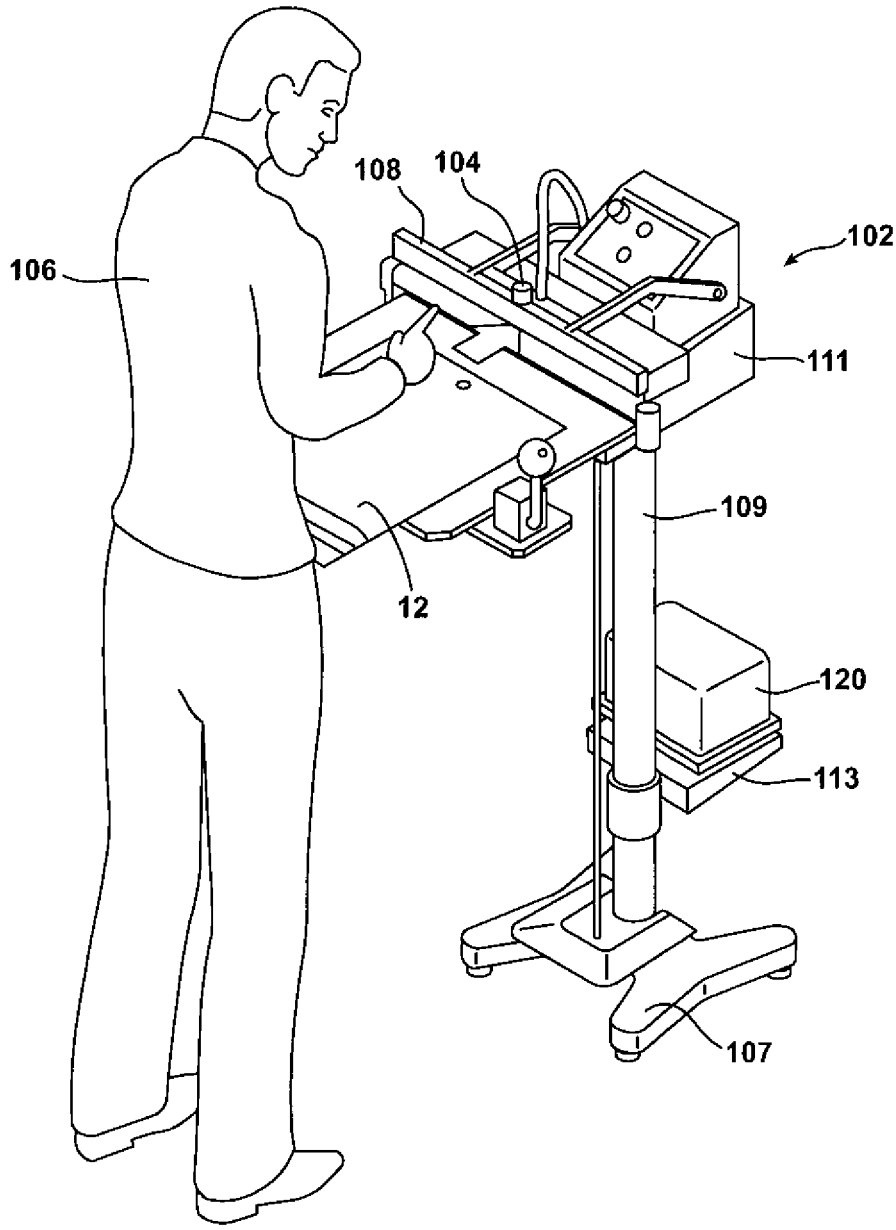
FIG. 13*a* is a perspective view of one embodiment of the disclosed inflation/sealing assembly.
Figure 13B:
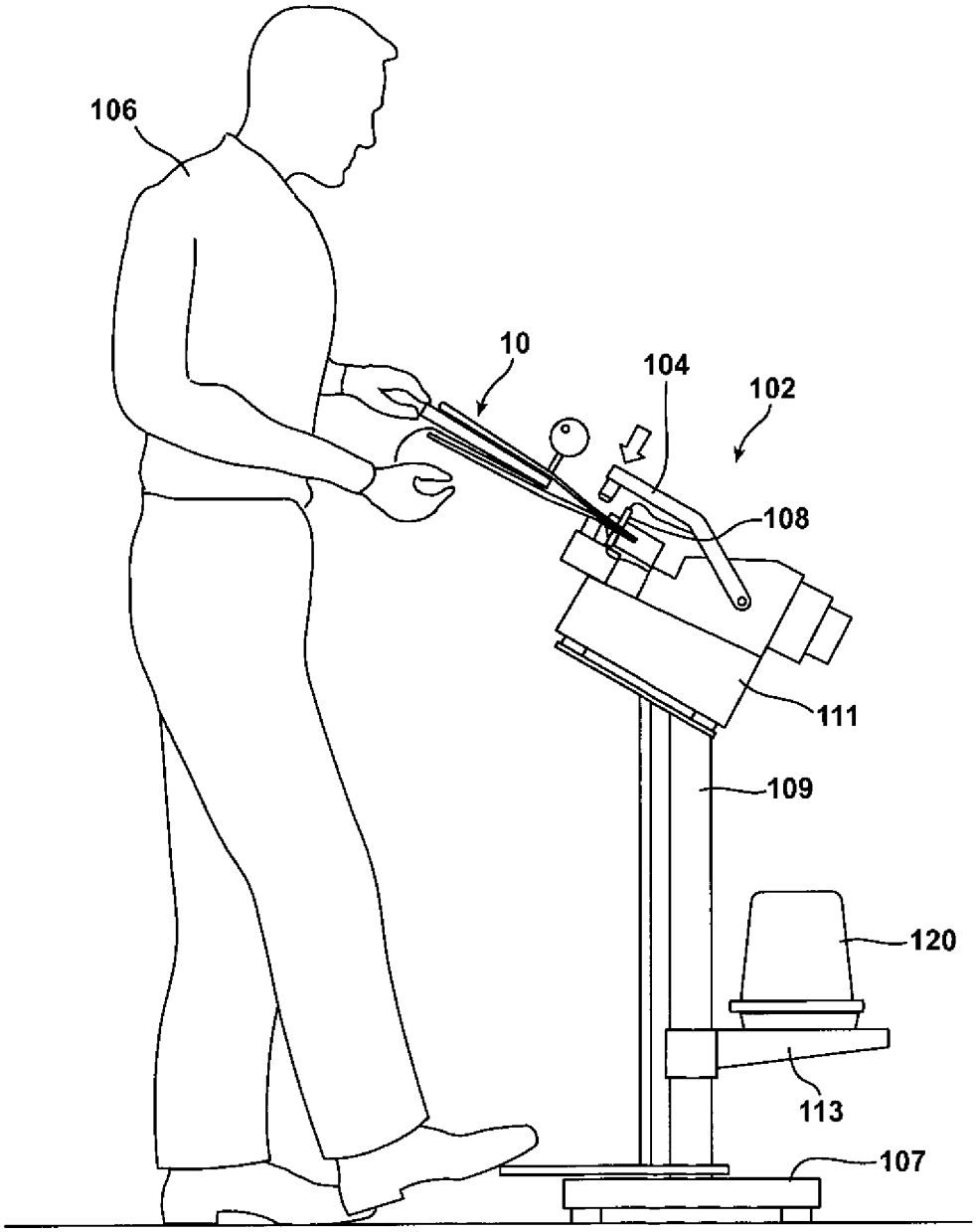
FIG. 13*b* is a side elevation view of the inflation/sealing assembly of FIG. 13*a*.

As generally depicted in FIGS. 13*a* and 13*b*, inflator/seal assembly 102 can include base 107 and/or support 109 that is mounted to the base. Base 107 can be constructed of a material having sufficient strength and weight to mechanically provide support for support 109, as would be well known to those of ordinary skill in the art. Support 109 supports a means to inflate liner 14 within pouch 12 and a means to seal off the inflation ports once the liner has been inflated. Particularly, inflation/seal assembly 102 comprises inflation assembly 104 and sealing assembly 108.

In the embodiments illustrated in FIGS. 13*a* and 13*b*, inflation assembly 104 is mounted to main block 111, which is in turn mounted to support 109. One of ordinary skill in the art would recognize that main block 111, and support 109 are optional and the presently disclosed subject matter includes embodiments that do not contain these features. Operator 106 initiates air flow from inflation assembly 102 to inflate liner 14 to a desired amount. Operator 106 can then initiate sealing assembly 108 to form longitudinal seal 72 in the mailer and isolate the inflation ports from the inflated channels in liner 14, as set forth in more detail herein below.

IV.B. Inflation Assembly 104

Figure 14A:
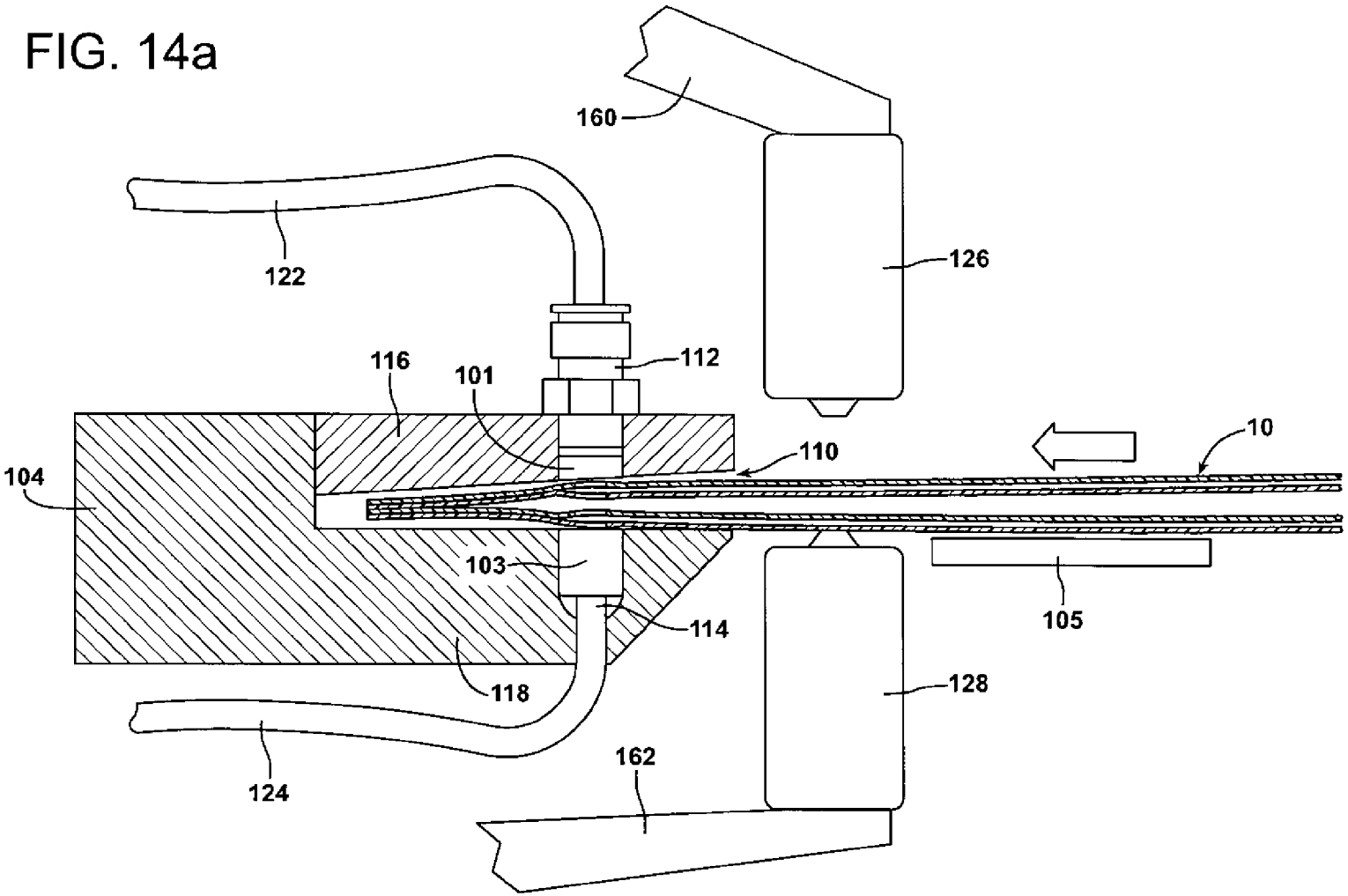
FIGS. 14*a* and 14*b* are side elevation views of one embodiment of the inflation of a mailer using the inflation/sealing assembly.
Figure 14B:
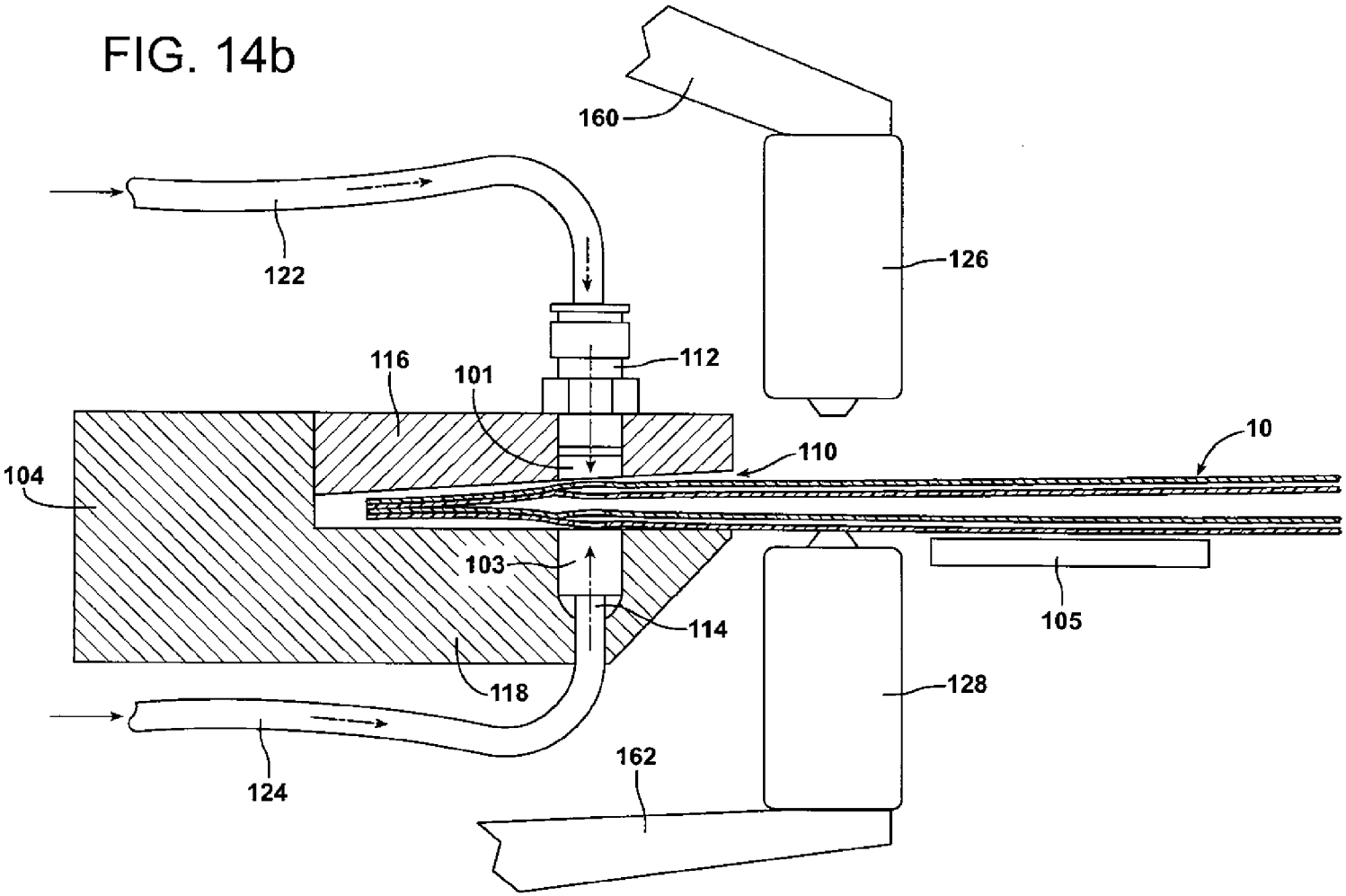

Inflation assembly 104 comprises upper and lower support arms 116, 118 that form mouth 110 for inserting mailer 10. The upper and lower support arms are positioned above and below the mouth, respectively, as depicted in FIGS. 14*a* and 14*b*. The inflation assembly also comprises at least one inflation nozzle positioned on at least one of the support arms. For example, as illustrated in the Figures, inflation nozzles 112, 114 can be positioned on upper and lower support arms 116, 118. Each inflation nozzle comprises an inlet port connected to a gas source and an outlet port positioned adjacent to an inflation means (i.e., an inflation port) in the mailer when the mailer is inserted into mouth 110. Thus, FIGS. 14*a* and 14*b* illustrate that upper and lower inflation nozzles 112, 114 comprise gas outlet ports 101 and 103 for injecting gas into mailer 10.

Figure 15A:
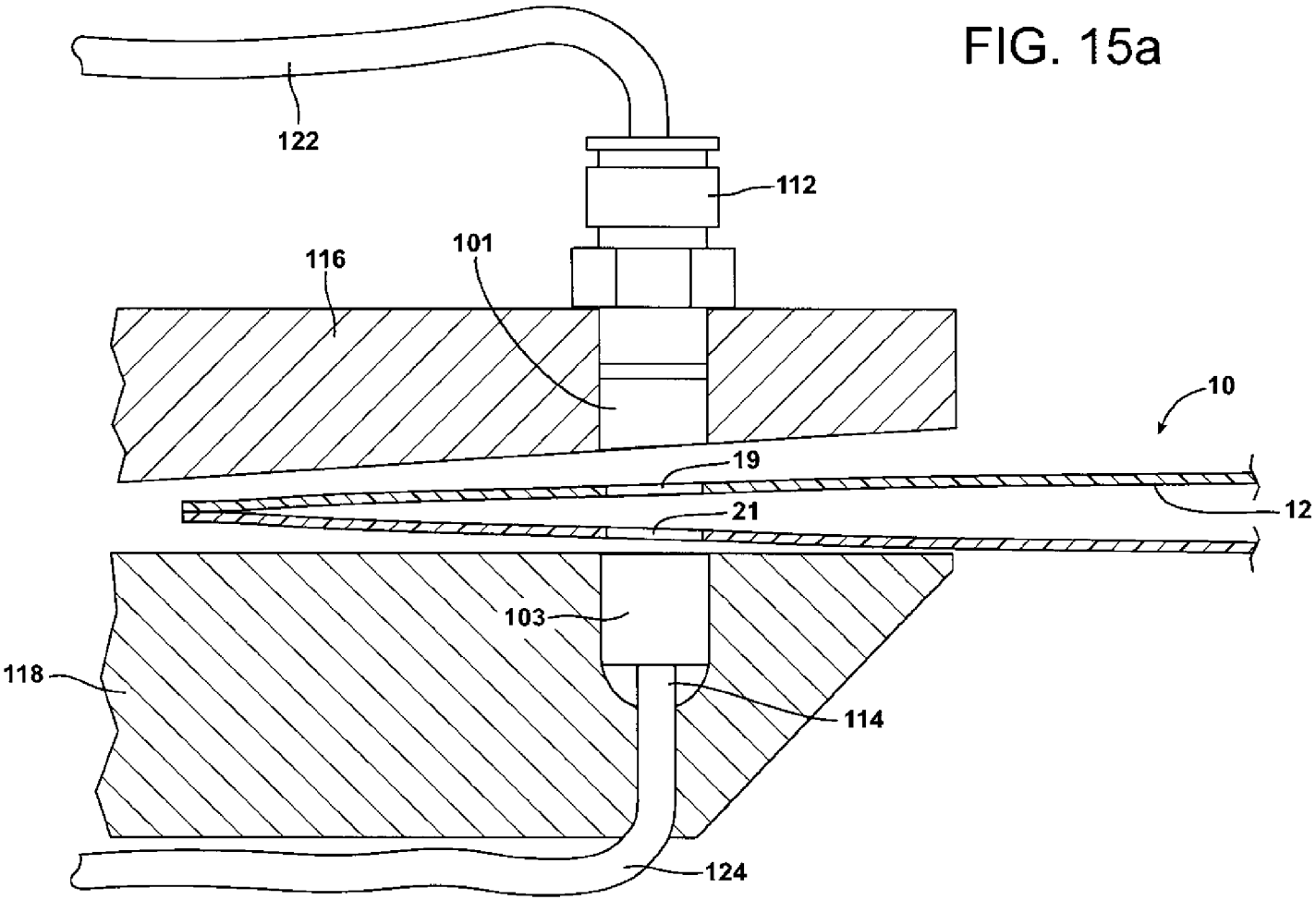
FIG. 15*a* is a side elevation view of one embodiment of a mailer in contact with the disclosed inflation assembly.
Figure 15B:
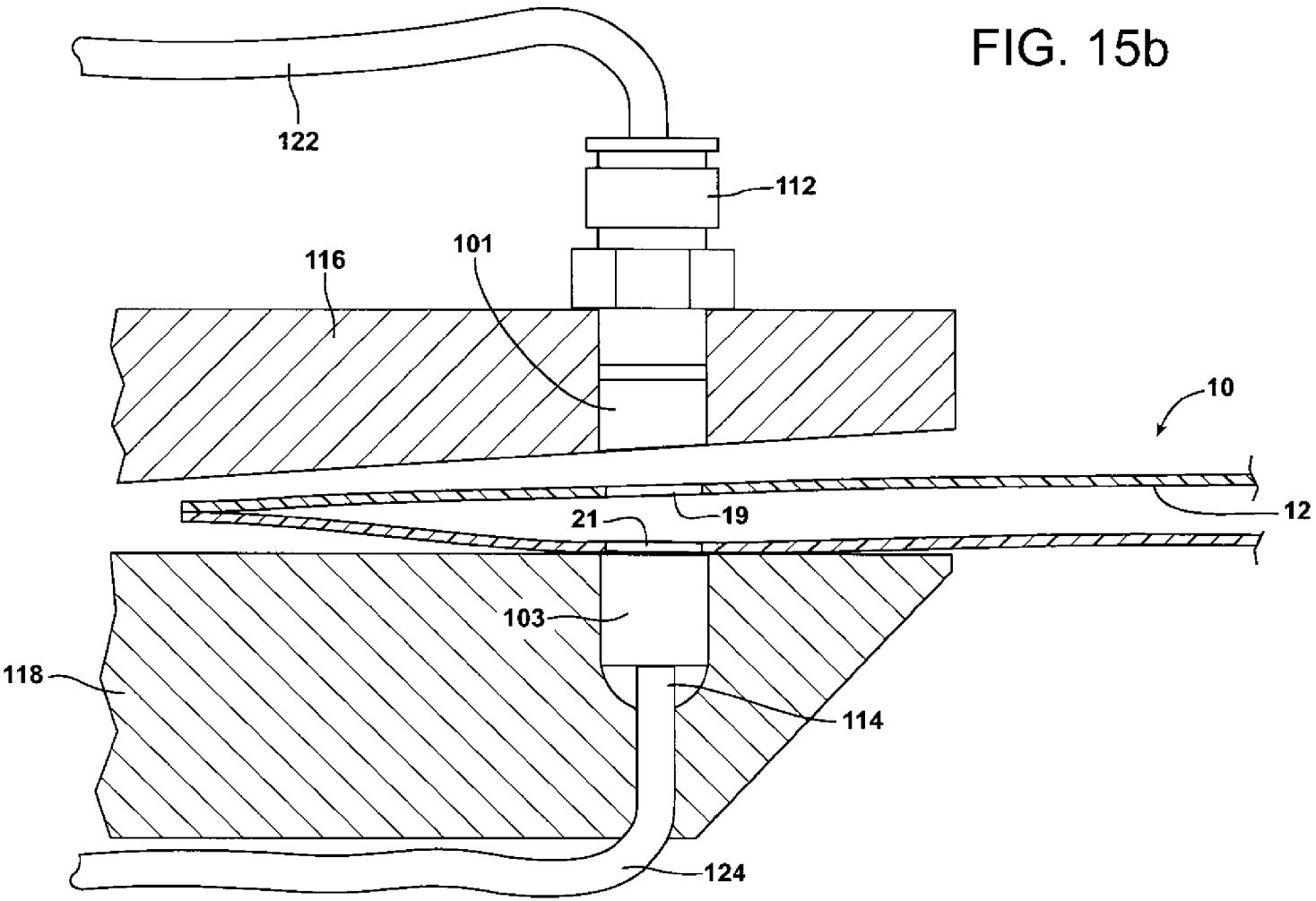
FIG. 15*b* is a side elevation view of one embodiment of a mailer in contact with the disclosed inflation assembly.
Figure 15C:
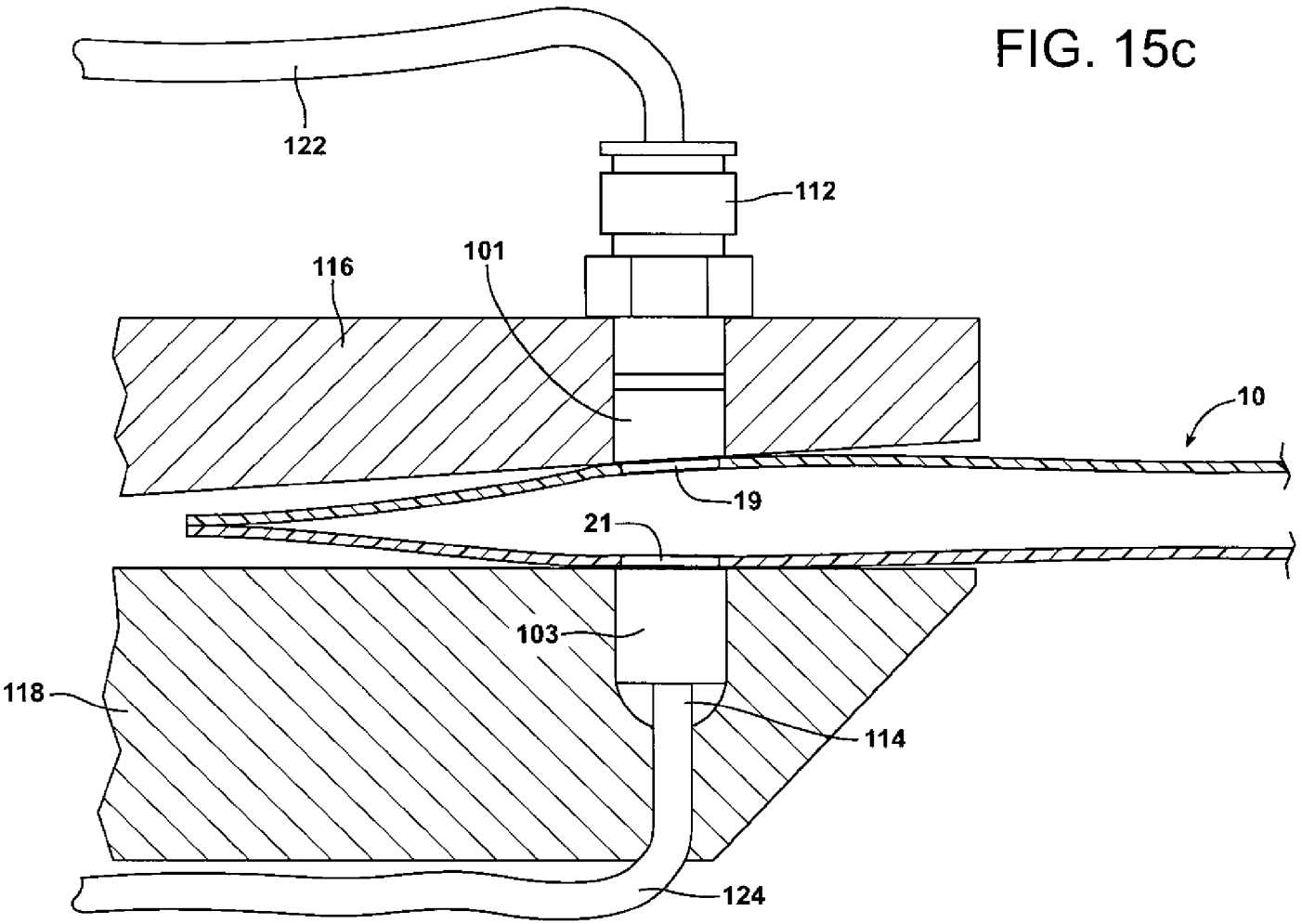
FIG. 15*c* is a side elevation view of one embodiment of an inflated mailer in contact with the disclosed inflation assembly.

The outlet port of the inflation nozzles initially may or may not contact the inflation ports in the pouch and the liner. Specifically, FIG. 15*a* illustrates a cutaway view of mailer 10 positioned within mouth 110 prior to inflation. Pouch ports 19, 21 are aligned with gas outlet ports 101 and 103 of inflation nozzles 112, 114. Although not illustrated in the Figure, the liner inflation ports are present and accessible through the pouch inflation ports. Thus, prior to inflation, there are some embodiments in which there is no direct contact between the inflation nozzle(s) and the mailer inflation means. Alternatively, FIG. 15*b* illustrates an embodiment wherein there is direct contact between an inflation nozzle and the mailer inflation means. As inflation begins, there is an initial burst of air that puffs up the mailer, resulting in contact between the mailer and one or both of the inflation nozzles. Although FIG. 15*b* depicts direct contact between the lower inflation nozzle and the mailer inflation means, the presently disclosed subject matter also includes embodiments wherein the mailer inflation means is in direct contact with the upper inflation nozzle or both the upper and lower inflation nozzles. As inflation occurs, upper and lower air nozzles directly contact upper and lower inflation ports in the pouch and liner, as depicted in FIG. 15*c*.

The inflation gas can be any gas that is suitable for inflating a mailer. For example, a preferred gas is ambient air, although other gases can suitably be employed, such as, e.g., $CO_2$, $N_2$ and the like. Gas can be delivered from a gas source to each inflation nozzle 112, 114 through hoses 122, 124. The gas can be supplied by an inflation source (such as, for example, air compressor 120 as depicted in FIGS. 13*a* and 13*b*, or from other sources known in the art, such as air compressors, compressed gas cylinders, "plant air" ((compressed air from a fixed, centralized source)), and the like). The compressor (or other means) can be mounted on support arm 113 of inflation/sealing assembly 102. Support arm 113 can be either permanently or removeably attached to or supported by support 109. Means for attaching support arm 113 can include (but are not limited to) welding, adhering, screwing, bolting, and the like. Other embodiments can secure the compressed air source in different configurations, which can include an external compressed air source.

Preferably, gas is introduced from inflation nozzles 112, 114 into liner 14 (via gas outlet ports 101 and 103) at greater than atmospheric pressure ranging, e.g., from about 1 to about 25 psi above atmospheric pressure, more preferably from about 2 to about 10 psi. In some embodiments, this can be achieved when compressor 120 generates a gas pressure of about 5 to about 80 psi; in some embodiments, from about 10 to about 50 psi; in some embodiments, from about 15 to about 35 psi; and in some embodiments, from about 2 to 10 psi. It is to be understood that the foregoing represent preferred ranges for the particular inflation nozzles 112, 114 as illustrated, and that other gas pressures can be more suitable if other types of inflation nozzles are employed. Further, the applied gas pressure from the inflation nozzles can be adjusted as necessary to provide a desired level of inflation in channels 46 of the liner.

In some embodiments, inflation assembly 104 can optionally comprise a pressure release means. Particularly, when mailer 10 reaches a desired pressure during inflation, the pressure release means opens to release pressure within the liner to ensure that the liner has a certain psi at the time of sealing. For example, in some embodiments, upper and/or lower inflation nozzles 112, 114 can contain a release valve (or any of a wide variety of instruments conventionally used in the art) to release pressure.

In some embodiments, hoses 122, 124 can optionally comprise a vent valve that routes the gas remaining in the hoses after the air source is turned off to the atmosphere. Alternatively, the vent valve can be positioned in the common line of an air source. The vent valve allows the quick release of gas from the hoses or common line once upper and lower seal jaws 126, 128 come together to reduce the air pressure within the mailer and thus ensure that a good heat seal forms.

IV.C. Sealing Assembly 108

Figure 16A:
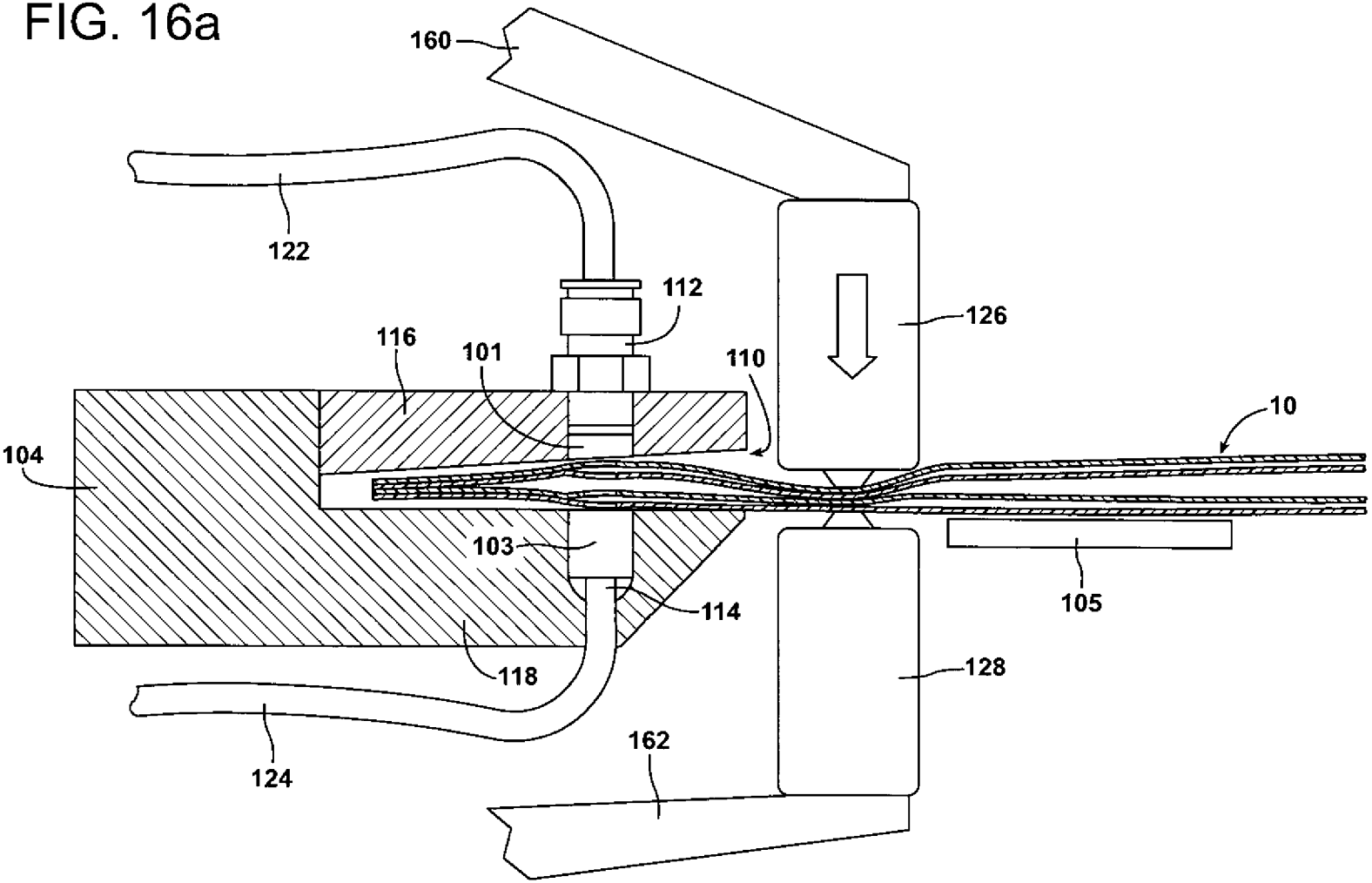
FIGS. 16*a* and 16*b* are side elevation views of one embodiment of the sealing of a mailer using the disclosed sealing assembly.
Figure 16B:
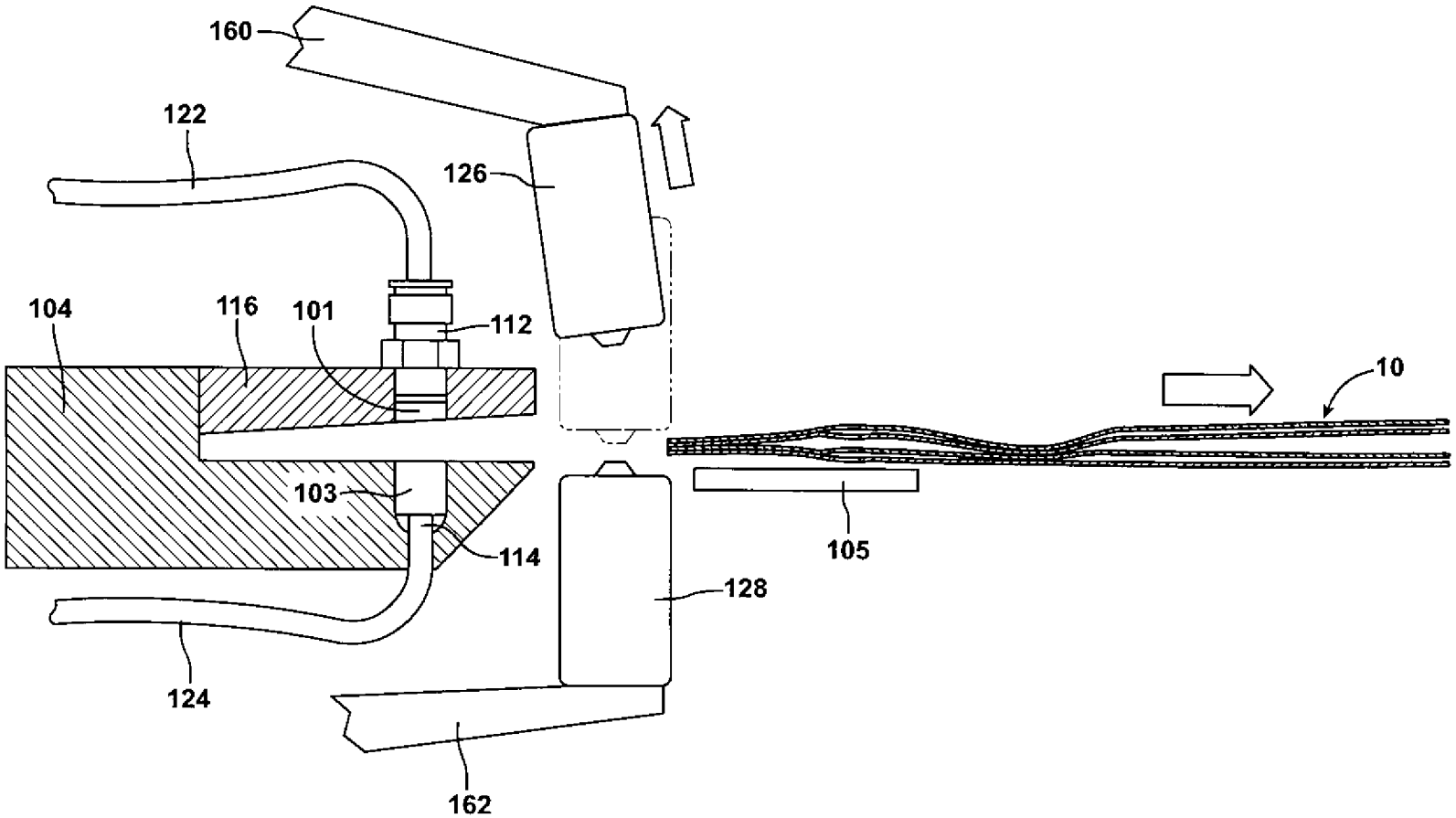

As illustrated in FIGS. 14*a* and 14*b*, when mailer 10 is positioned for inflation, it is also in the correct position for sealing with sealing assembly 108. Particularly, in some embodiments, the sealing assembly is disposed downstream from the inflation assembly. Sealing assembly 108 comprises upper and lower support arms 160, 162 positioned above and below the inflation/seal assembly mouth. Sealing assembly 108 comprises upper and lower heat seal jaws 126, 128 positioned on the upper and lower support arms, respectively. At least one heat seal element (i.e., a seal bar) is positioned on at least one of the heat seal jaws. In some embodiments, the upper and lower seal jaws are mounted to main block 111. In some embodiments, upper seal jaw 126 can be maneuvered upward and downward to seal mailer 10, as depicted in FIGS. 16*a* and 16*b*. In some embodiments, upper seal jaw 126 moves while lower seal jaw 128 remains stationary. However, the presently disclosed subject matter also includes embodiments wherein both the upper and lower seal jaws move and/or the upper seal jaw is stationary and the lower seal jaw moves.

Thus, in some embodiments, upper jaw 126 moves towards lower seal jaw 128 to engage mailer 10 therebetween and thus form longitudinal seal 72. For example, in some embodiments, upper seal jaw 126 comprises a heat seal bar that includes a heat seal wire. When the upper seal jaw moves towards the lower seal jaw, current is passed through the heat seal wire to thereby form a heat seal. In some embodiments the heat seal wire extends at least across the internal width of the inflation inlet (i.e., the common channel) to define a heat seal zone. After forming the heat seal, the seal jaws are then separated. The upper and lower heat seal jaws can form the longitudinal seal using any of a wide variety of conventional methods known in the art and are not limited to the heat seal wire embodiment herein described.

Thus, the seal jaws function to heat the films of the mailer to a substantially elevated temperature by contacting with a means for sealing (e.g., a heat seal wire in some embodiments). Thus, in some embodiments, sealing can be initiated by contacting the films with the means for sealing that is at ambient temperatures. In this case, the moment at which sealing is initiated is the moment at which the means for sealing begins to apply heat to the film. Alternatively, in some embodiments, the means for sealing could be preheated before it is brought into contact with the mailer, so that upon contact with the mailer it immediately begins to apply heat. In this case, the moment at which sealing is initiated is the moment at which the preheated means for sealing contacts the films of the mailer. Regardless of which embodiment is utilized, the sealing assembly requires the application of enough heat that at least a portion of the sealing layer of the films of the mailer reach the glass transition temperature of at least one of the polymers making up the seal layer of the film.

When the sheets of pouch 12 and/or liner 14 are formed form a thermoplastic film, the sealing temperature necessary to form longitudinal seal 72 is that which causes the film sheets to weld or fuse together by becoming temporarily fully or partially molten in the area of contact with the seal jaws. Such temperature, i.e., the "sealing temperature," can readily be determined by those of ordinary skill in the art without undue experimentation for a given application based on, e.g., the composition and thickness of the film sheets to be sealed, the speed at which the film sheets move against the heating element, and the pressure at which the film sheets and heating element are urged together. Although discussion of sealing assembly 108 has been included herein, the presently disclosed subject matter also includes embodiments wherein the apparatus comprises only an inflation assembly (i.e., the sealing assembly is optional).

IV.D. Operation of Inflation/Sealing Assembly 102

Once an article to be packaged is loaded into mailer 10 and flap 28 has been sealed, the mailer proceeds to inflation assembly 104 of inflation/sealing assembly 102, as depicted in FIG. 14*a*. Alternatively, in some embodiments, mailer 10 can proceed to inflation assembly 104 prior to sealing flap 28. In such embodiments, the mailer is first inflated, then the article to be packaged is inserted into the inflated mailer, and the mailer is then sealed with flap 28.

Particularly, the user slides uninflated mailer 10 into the inflation/sealing assembly mouth 110 so that the pouch and liner inflation ports are aligned with inflation nozzles 112, 114. The mailer is inserted such that the outlet ports of the inflation nozzles are aligned with the inflation ports of the mailer. In some embodiments, the uninflated mailer can rest on support means 105 during inflation and sealing. After correctly positioning the mailer into inflation/sealing assembly mouth 110, the user can then initiate air flow from a gas source into the inflation nozzles by pressing a button or initiating a foot pedal (or other initiating means) that blows gas into the inflatable liner through the upper and lower pouch inflation ports. After activation, a pressurized inflation medium, such as compressed air, is transmitted from a compressor (or other source) through hoses 122, 124 into upper and lower inflation nozzles 112 and 114. The pressurized gas passes through gas outlet ports 101 and 103 and subsequently through pouch ports 19, 21.

As discussed above, the inflation nozzle is capable of initiating inflation with or without direct contact with the inflation means. As used herein, the term "direct contact" refers to contact wherein the inflation nozzle actually touches the inflation port. Thus, in embodiments wherein the inflation nozzle directly contacts the inflation port, the two are in touching contact. In embodiments wherein the inflation nozzle does not directly contact the inflation port, once inflation begins and gas is inserted into the liner, the gas pushes the liner outward into contact with the inflation nozzle.

Figure 17A:
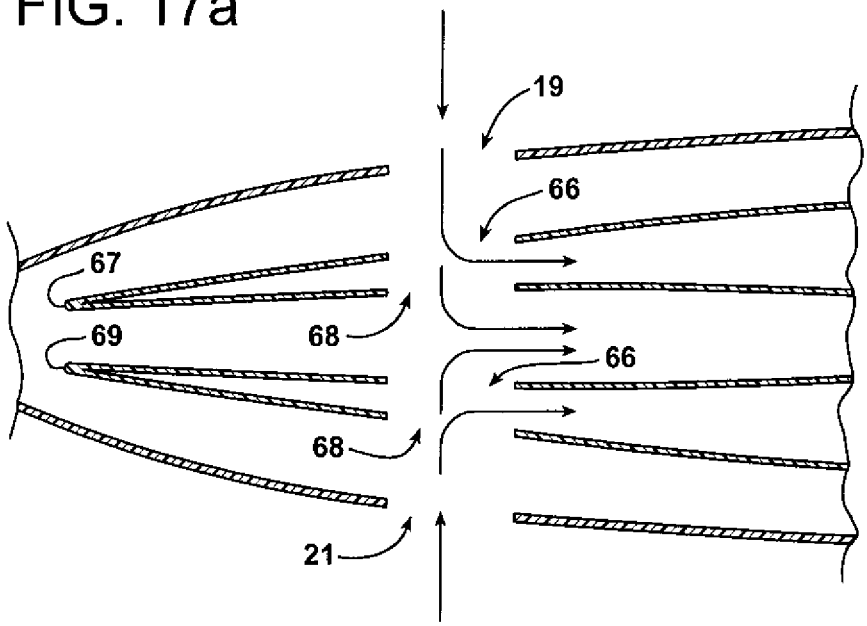
FIGS. 17*a* and 17*b* are side elevation views of alternating embodiments of air flow into the mailer.

The arrows of FIG. 17*a* depict the flow of gas into mailer 10 in embodiments wherein upper and lower liner inflation ports 66, 68 span all film layers of the inflatable liner. Particularly, gas flows from top and bottom inflation nozzles 112, 114 through upper and lower pouch inflation ports 19, 21. Gas will then flow into upper and lower liner inflation ports 66, 68 of upper and lower liner layers 67, 69. Thus, in embodiments wherein the liner inflation ports span all of the liner film layers, gas flows from the upper and lower air nozzles 112, 114 into both layers of liner 14 and in between the layers of the liner. The gas that is funneled in between the layers of the liner is leaked gas, i.e., gas that is leaked out of the mailer.

Figure 17B:
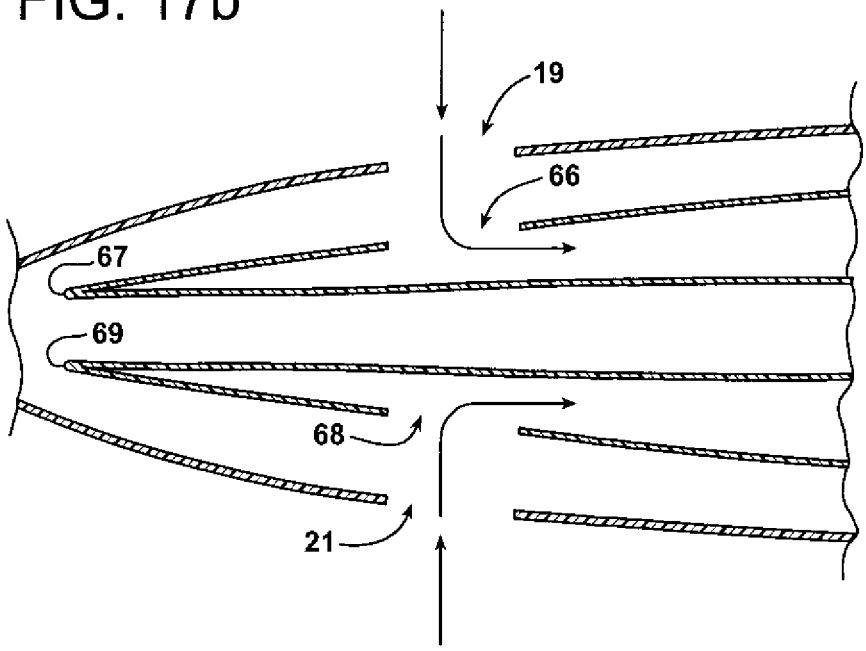

FIG. 17*b* depicts the flow of gas into liner 14 in embodiments wherein upper and lower liner inflation ports 66, 68 span only the top and bottom of the 4 layers of the liner. Specifically, gas will flow from top inflation nozzle 112 through upper pouch inflation port 19 and then through upper liner inflation port 66 of upper liner layer 67. Gas will simultaneously flow from lower inflation nozzle 114 through lower pouch inflation port 21 and then through lower liner inflation port 68 of lower liner layer 69. The introduction of gas into the mailer causes outward expansion of the liner, resulting in a seal being created against the inflation means (i.e., inflation ports 66, 68).

During inflation, the gas flows from the liner inflation ports into common channel 48 to fill channels 46 causing them to inflate. As the channels reach capacity, the internal air pressure causes inflatable channels 46 to expand. As air inflates the mailer, the mailer comes into contact with one or both air nozzles, thus sealing off air from the mailer. In some embodiments, the internal air pressure and lateral/circumferential stretching forces cause the common channel to close, thereby preventing further ingress or egress of air from the structure. The internal air pressure forces the inner sheets of the liner into contact, thereby isolating the liner inflation ports, resulting in a self-sealing action. In some embodiments, the inflation/sealing device comprises a pressure bar mounted in front of at least one sealing jaw to at least partially flatten each inflatable chamber in the area adjacent to the seal line to prevent stretching of the heated film at the seal area.

As disclosed in detail herein above, gas will flow from the inflation ports through common channel 48 into channels 46. Once a desired amount of air has been blown into the liner, the user can initiate sealing of mailer 10 via sealing assembly 108. Particularly, after liner 14 has been inflated to a desired amount, user 106 can initiate assembly 108 by pressing a button (or initiating a footswitch or other means) to engage at least one seal jaw to seal and isolate the inflation means from the inflated channels of the liner. For example, FIGS. 16*a* and 16*b* depict upper seal jaw 126 in contact with the mailer. Air flow from inflation assembly 104 is then automatically stopped and the mailer is cross-sealed with longitudinal seal 72. Alternatively, in some embodiments, because mailer 10 is under high pressure as a result of inflation, the gas supply from inflation assembly 104 can optionally be turned off just prior to the contact between the seal jaws of the sealing assembly. As a result, the pressure within the mailer is lower and allows the sealing jaws to come together more easily to form longitudinal seal 72.

In some embodiments, after liner 14 has been inflated to a desired amount, user 106 can initiate assembly 108 by manually pressing a button (or initiating a footswitch or other means) to close upper seal jaw 126 into contact with the mailer. In such embodiments, the user steps down on the footswitch (or presses a button) which causes the two sealing jaws to contact. The heat cycle then begins and continues for a set time. When the heat cycle is complete, the user is notified by some means (i.e., a light, noise, etc.).

As an alternative to the user manually initiating sealing of mailer 10 via heat sealing assembly 108, inflation/sealing assembly 102 can comprise a pressure sensore that automatically reads and/or turns off inflation and initiates the heat sealing assembly. Specifically, the pressure reading switch can be positioned on one or both inflation nozzles 112, 114 or on one or both gas outlet ports 101, 103. When the pressure reaches a set amount, the inflation automatically ceases and the sealing assembly is initiated. The heat sealing can proceed for a set time, after which the heat seal jaws move apart.

Figure 18:
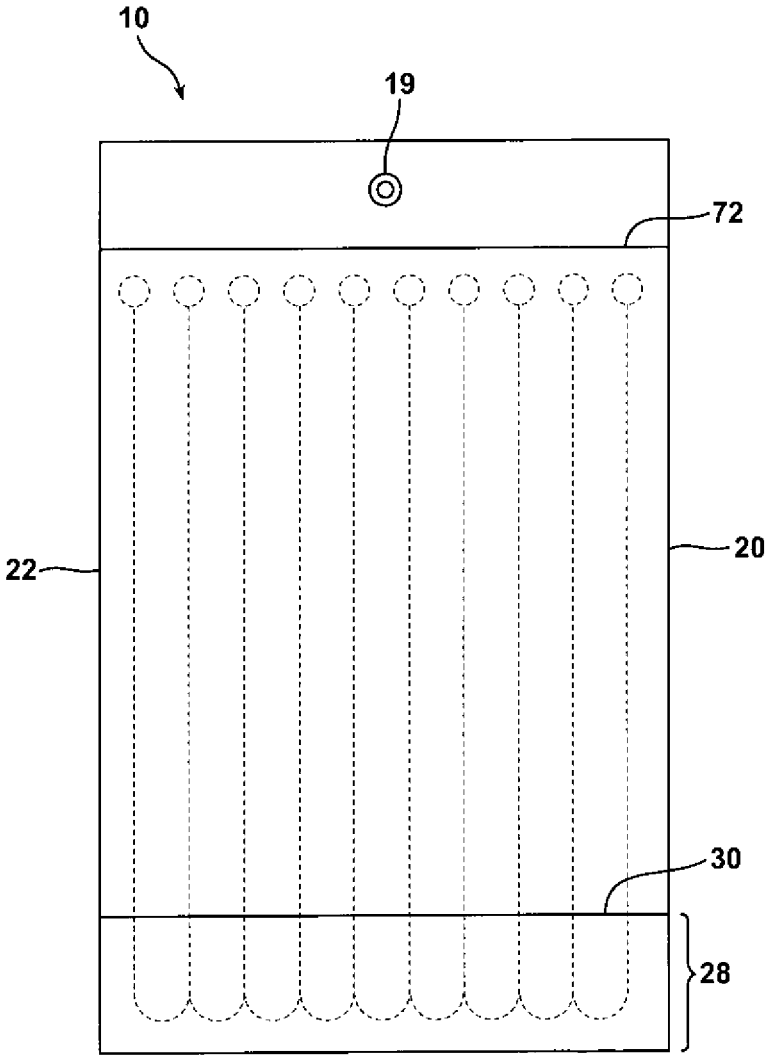
FIG. 18 is a top plan view of one embodiment of an inflated mailer after sealing.

Longitudinal seal 72 is a hermetic closure formed across all layers of the mailer to isolate each inflated channel of the liner from the inflation ports. The sealing assembly preferably seals closed the inflation ports by forming a continuous longitudinal seal spanning to pouch edges 20, 22 as shown in FIG. 18. In some embodiments, the longitudinal seal isolates the inflation ports from the inflatable channels. Thus, in some embodiments, the longitudinal seal is located within the common channel. As a result of forming the longitudinal seal, channels 46 no longer communicate with the inflation ports or the pouch ports. After the heat seal has been formed, the upper seal jaw is automatically retracted to a disengaged position from the inflated and sealed mailer using any of a variety of means well known in the art (e.g., a spring return.

Thus, the sealing assembly is adjustable between an engaged position and a disengaged position. In the engaged position, the seal bar is capable of compressing the inflatable mailer between the upper and lower heat seal jaws. In the disengaged position, the upper and lower heat seal jaws are spaced apart such that the mailer can be inserted or withdrawn from between the upper and lower support arms. The inflated and sealed mailer is then removed from the inflation/sealing assembly.

The inflatable mailer of the present invention can be inflated and sealed by the sealer/inflator device of the present invention. The inventive sealer/inflator and its related aspects are the subject matter of U.S. patent application Ser. No. 12/387,572 to Kannankeril et al. entitled "INFLATABLE MAILER, APPARATUS, AND METHOD FOR MAKING THE SAME" filed on the same day and owned by the same entity as the present application. That application is incorporated herein in its entirety by this reference.

V. Shipping/Opening

After sealing, the upper seal bar opens and the inflated mailer is removed. FIG. 1*b* illustrates one embodiment of an inflated mailer comprising liner 14 and pouch 12. An address label can be placed on one surface of the mailer for shipping purposes.

After transit, the recipient can open the mailer using a standard pull tab or the like. Alternatively, the mailer can be opened using a tool such as a knife. In some embodiments, pouch 12 can comprise a perforated strip located at one end of the pouch that the recipient can tear off to open the pouch, as disclosed herein above.

VI. Advantages of the Presently Disclosed Subject Matter

The presently disclosed subject matter comprises several advantages compared to mailers and inflation/sealing devices known in the prior art. For example, the disclosed inflation/sealing device offers a shorter cycle time between inflation and sealing compared with devices conventional in the art.

In addition, the disclosed method and device do not require pre-filling of the mailer and thus are simpler and more efficient to use, as opposed to many inflation devices commonly used in the art. For example, prior art mailers commonly require that a pre-measured amount of air be deposited into the inflation channels.

Continuing, the disclosed inflation/sealing device is simpler and lower in cost compared to prior art devices.

Further, manufacture of the disclosed mailer is less cumbersome compared to prior art mailers used in the art. To this end, in some embodiments, the inner liner and outer bag are detached and not connected together, allowing for ease of use and assembly.

Although several advantages of the disclosed system are set forth in detail herein, the list is by no means limiting. Particularly, one of ordinary skill in the art would recognize that there can be several advantages to the disclosed system that are not included herein.

What is claimed is:

1. An inflatable mailer comprising:

a. a pouch comprising front and rear sheets that are oriented in face-to-face relation, wherein each sheet comprises:

i. a top edge, a bottom edge, and two opposite side edges, wherein the sheets are connected along the bottom edge and along opposite side edges to define an interior space, and wherein the top edges of the sheets are unconnected to form an opening into said interior space; and ii. at least one pouch inflation port positioned at the top or bottom edge of at least one sheet;

b. a completely inflatable liner disposed in said interior space in an uninflated state, said inflatable liner comprising front and rear webs oriented in face-to-face relation, wherein each web comprises:

i. a top edge, a bottom edge, and opposite side edges, wherein the side edges of the front and rear webs are interconnected and at least one of the top or bottom edges are at least partially connected;

ii. two sheets having inner surfaces sealed to each other in a pattern defining a series of inflatable chambers and at least one common channel in fluid communication with said series of inflatable chambers, wherein said pattern includes uninflated continuous planar regions between the inflatable chambers to define the inflatable channels;

iii. a liner inflation port disposed on at least one of the two sheets in at least one of the two webs, wherein said liner inflation ports are aligned with said pouch inflation ports, and whereby an inflation pathway is created through which a portion of gas can be introduced into said liner; and wherein said liner inflation port is a hole or a slit on at least one of the two sheets in at least one of the two webs.

2. The inflatable mailer of claim 1, wherein each sheet of said pouch comprises a heat-sealable thermoplastic polymer on its inner surface.

3. The inflatable mailer of claim 1, wherein a portion of said rear sheet extends beyond said opening to define a flap, said flap comprising a sealing agent and a release liner covering said sealing agent.

4. The inflatable mailer of claim 1, wherein said common channel is connected to each inflatable channel by at least one neck.

5. The inflatable mailer of claim 1, wherein said liner comprises at least one gusset fold.

6. The inflatable mailer of claim 1, wherein said liner comprises at least one arrow fold.

7. The mailer of claim 1, wherein said liner inflation ports span all sheets of the inflatable liner.

8. The mailer of claim 1, wherein said liner inflation ports span one sheet of both webs.

9. The mailer of claim 1, further comprising an article positioned between the two webs.

10. The mailer of claim 1, wherein the pouch inflation ports are aligned with each other.

11. The mailer of claim 1, wherein said at least one pouch inflation port is positioned in close proximity to the pouch bottom edge and approximately equidistant from the pouch side edges.

12. The mailer of claim 1, wherein said pouch is constructed from thermoplastic material, cardboard, paperboard, paper, foil, canvas, cloth, foamed film, and combinations thereof.

13. The mailer of claim 1, wherein the outer pouch surface has writing capabilities, printing capabilities, adheres to gum and water-based adhesives, or combinations thereof.

14. The mailer of claim 1, wherein the pouch, liner, or both comprises at least one barrier layer.

15. The mailer of claim 1, wherein the pouch, liner, or both comprises one or more antistatic film materials.

16. The mailer of claim 1, wherein said liner inflation ports are positioned in close proximity to the pouch bottom edge and approximately equidistant from the pouch side edges.

17. The mailer of claim 1, wherein each inflatable chamber is of substantially the same length.

18. The mailer of claim 1, wherein said channels comprise successive non-linear and linear inflatable narrow channels having no change in width along their length.

19. The mailer of claim 1, wherein said channels are non-linear and oscillate with respect to the liner edges with a bubble disposed at the apex and valley of each oscillation.

20. The mailer of claim 1, further comprising at least one spot seal positioned between the front and rear webs.

* * * * *